US012313391B2

(12) United States Patent
Wicks et al.

(10) Patent No.: US 12,313,391 B2
(45) Date of Patent: May 27, 2025

(54) WIRELESS INITIATION DEVICE

(71) Applicant: Orica International Pte Ltd, Singapore (SG)

(72) Inventors: Byron Wicks, Singapore (SG); Dirk Hummel, Singapore (SG); Thomas Boos, Singapore (SG)

(73) Assignee: Orica International Pte Ltd, Singapore (SG)

( * ) Notice: Subject to any disclaimer, the term of this patent is extended or adjusted under 35 U.S.C. 154(b) by 191 days.

(21) Appl. No.: 17/571,278

(22) Filed: Jan. 7, 2022

(65) Prior Publication Data

US 2022/0128343 A1 Apr. 28, 2022

Related U.S. Application Data

(63) Continuation of application No. 15/761,061, filed as application No. PCT/SG2015/050322 on Sep. 16, 2015, now Pat. No. 11,248,895.

(51) Int. Cl.
*F42B 3/10* (2006.01)
*F42D 1/045* (2006.01)
(Continued)

(52) U.S. Cl.
CPC ..... *F42D 3/04* (2013.01); *F42B 3/10* (2013.01); *F42D 1/045* (2013.01); *F42D 1/055* (2013.01);
(Continued)

(58) Field of Classification Search
CPC .. F42B 3/10; F42B 3/103; F42B 3/121; F42B 3/122; F42B 3/182; F42D 1/045; F42D 1/055; F42D 1/05; F42D 3/04; F42D 5/00
(Continued)

(56) References Cited

U.S. PATENT DOCUMENTS 2,411,787 A 11/1946 Hammond, Jr.
2,530,333 A 11/1950 Jost
(Continued)

FOREIGN PATENT DOCUMENTS

AU 1761695 A 11/1995
AU 2002336727 B2 10/2007
(Continued)

OTHER PUBLICATIONS

A New Era of Blast Initiation Systems reducing Safety Risks_Lovitt et al._ pp. 1-12_2017.*
(Continued)

*Primary Examiner* — Timothy J Thompson
*Assistant Examiner* — Guillermo J Egoavil

(57) ABSTRACT

A wireless initiation device comprises a power source, a processing module, a first housing and an initiation unit. The processing module processes wireless electromagnetic communications signals received by an electromagnetic receiver system associated with the processing module. The wireless electromagnetic communications signals includes a wireless electromagnetic communications signal representative of a FIRE command. The processing module is configured to generate an initiation signal upon receipt of the FIRE command. At least one of the power source and the processing module is disposed in the first housing, and the first housing has a first connector. The initiation unit has a second housing within which is disposed an initiation module that is configured to discharge initiation energy sufficient to initiate an explosive charge associated with the device. The initiation module is connected to, or connectable with, the processing module such that initiation module can receive an initiation signal from the processing module. The initiation unit also has a second connector that is configured to mate with the first connector, thereby connecting the first
(Continued)

and second housings. The initiation module is configured to execute a sequence upon receipt of the initiation signal, the sequence resulting in discharge of initiation energy from the initiation unit.

21 Claims, 13 Drawing Sheets

(51) Int. Cl.

| | |
|---|---|
| ***F42D 1/055*** | (2006.01) |
| ***F42D 3/04*** | (2006.01) |
| *F42B 3/103* | (2006.01) |
| *F42B 3/12* | (2006.01) |
| *F42D 5/00* | (2006.01) |

(52) U.S. Cl.
CPC ..... *F42B 3/103* (2013.01); *F42B 3/121* (2013.01); *F42B 3/122* (2013.01); *F42D 5/00* (2013.01)

(58) Field of Classification Search
USPC ..... 361/249; 102/200, 206
See application file for complete search history.

(56) References Cited

U.S. PATENT DOCUMENTS

| | | | | |
|---|---|---|---|---|
| 3,421,440 | A | 1/1969 | Snyder | |
| 3,757,697 | A | 9/1973 | Phinney | |
| 3,780,654 | A | 12/1973 | Shimizu et al. | |
| 3,834,310 | A | 9/1974 | Ueda et al. | |
| 3,905,298 | A | 9/1975 | Rehbock | |
| 3,971,317 | A | 7/1976 | Gemmell et al. | |
| 3,987,732 | A | 10/1976 | Spraggs et al. | |
| 4,145,970 | A | 3/1979 | Hedberg et al. | |
| 4,576,093 | A | 3/1986 | Snyder | |
| 4,615,268 | A | 10/1986 | Nakano et al. | |
| 4,685,396 | A | 8/1987 | Birse et al. | |
| 4,712,477 | A | 12/1987 | Aikou et al. | |
| 4,860,653 | A | 8/1989 | Abouav | |
| 4,869,170 | A | 9/1989 | Dahmberg et al. | |
| 4,869,171 | A | 9/1989 | Abouav | |
| 4,884,506 | A | 12/1989 | Guerreri | |
| 5,038,682 | A | 8/1991 | Marsden | |
| 5,090,321 | A | 2/1992 | Abouav | |
| 5,159,149 | A | 10/1992 | Marsden | |
| 5,206,455 | A | 4/1993 | Williams et al. | |
| 5,214,236 | A | 5/1993 | Murphy et al. | |
| 5,295,438 | A | 3/1994 | Hill et al. | |
| 5,488,908 | A | 2/1996 | Gilpin et al. | |
| 5,520,114 | A | 5/1996 | Guimard et al. | |
| 5,585,591 | A | 12/1996 | Waldock | |
| 6,112,668 | A | 9/2000 | Woodall et al. | |
| 6,158,769 | A * | 12/2000 | Swann | B60R 21/268 280/736 |
| 6,173,651 | B1 | 1/2001 | Pathe et al. | |
| 6,253,679 | B1 | 7/2001 | Woodall et al. | |
| 6,283,227 | B1 | 9/2001 | Lerche et al. | |
| 6,311,621 | B1 | 11/2001 | Marshall et al. | |
| 6,422,145 | B1 * | 7/2002 | Gavrilovic | F42C 13/047 102/202.1 |
| 6,584,907 | B2 | 7/2003 | Boucher et al. | |
| 6,618,237 | B2 | 9/2003 | Eddy et al. | |
| 6,644,202 | B1 | 11/2003 | Duniam et al. | |
| 6,757,531 | B1 | 6/2004 | Haaramo et al. | |
| 6,789,483 | B1 | 9/2004 | Jennings, III et al. | |
| 6,860,206 | B1 | 3/2005 | Rudakevych et al. | |
| 6,938,689 | B2 | 9/2005 | Farrant et al. | |
| 6,988,449 | B2 | 1/2006 | Teowee et al. | |
| 7,103,510 | B2 | 9/2006 | Moolman et al. | |
| 7,106,690 | B2 | 9/2006 | Song | |
| 7,197,148 | B2 | 3/2007 | Nourse et al. | |
| 7,272,389 | B2 | 9/2007 | Shiozawa | |
| 7,327,550 | B2 | 2/2008 | Meyer et al. | |
| 7,370,583 | B2 | 5/2008 | Jönsson et al. | |
| 7,446,671 | B2 | 11/2008 | Giannopoulos et al. | |
| 7,778,006 | B2 | 8/2010 | Stewart et al. | |
| 7,810,430 | B2 | 10/2010 | Chan et al. | |
| 7,929,270 | B2 | 4/2011 | Hummel et al. | |
| 8,385,042 | B2 | 2/2013 | McCann et al. | |
| 8,395,878 | B2 | 3/2013 | Stewart et al. | |
| 8,746,144 | B2 | 6/2014 | Givens et al. | |
| 11,248,895 | B2 | 2/2022 | Wicks et al. | |
| 2002/0112860 | A1 | 8/2002 | McDaniel | |
| 2002/0178955 | A1 * | 12/2002 | Gavrilovic | F42D 1/05 102/200 |
| 2003/0000411 | A1 | 1/2003 | Cernocky et al. | |
| 2004/0061660 | A1 * | 4/2004 | Yoshida | H01Q 21/28 343/788 |
| 2004/0199272 | A1 | 10/2004 | Yamamoto et al. | |
| 2005/0034624 | A1 | 2/2005 | Forman et al. | |
| 2005/0103219 | A1 | 5/2005 | McClure et al. | |
| 2005/0125552 | A1 * | 6/2005 | Katayama | H04L 67/04 709/224 |
| 2006/0027123 | A1 | 2/2006 | Van Dyk et al. | |
| 2006/0042495 | A1 | 3/2006 | Russell | |
| 2006/0251033 | A1 | 11/2006 | Oprescu-Surcobe et al. | |
| 2007/0119326 | A1 * | 5/2007 | Rudakevych | F42C 15/42 102/206 |
| 2008/0173204 | A1 | 7/2008 | Anderson et al. | |
| 2008/0218087 | A1 | 9/2008 | Crouse et al. | |
| 2008/0282924 | A1 | 11/2008 | Saenger et al. | |
| 2008/0302264 | A1 | 12/2008 | Hummel et al. | |
| 2008/0307993 | A1 | 12/2008 | Chan et al. | |
| 2009/0084535 | A1 | 4/2009 | Bertoja et al. | |
| 2009/0193993 | A1 * | 8/2009 | Hummel | F42D 1/055 901/50 |
| 2011/0038410 | A1 * | 2/2011 | Narroschke | H04N 19/70 375/240.03 |
| 2011/0174181 | A1 | 7/2011 | Plummer et al. | |
| 2011/0277620 | A1 | 11/2011 | Havran et al. | |
| 2012/0042800 | A1 | 2/2012 | McCann et al. | |
| 2012/0299708 | A1 | 11/2012 | Guyon et al. | |
| 2013/0098257 | A1 | 4/2013 | Goodridge et al. | |
| 2013/0125772 | A1 * | 5/2013 | Backhus | F42D 5/00 102/206 |
| 2014/0053750 | A1 | 2/2014 | Lownds et al. | |
| 2014/0311370 | A1 * | 10/2014 | Koekemoer | F42C 11/001 102/217 |
| 2014/0338552 | A1 | 11/2014 | Mace et al. | |
| 2015/0013560 | A1 | 1/2015 | Schlenter et al. | |
| 2017/0074630 | A1 * | 3/2017 | Kotsonis | F42D 1/05 |
| 2017/0328696 | A1 | 11/2017 | Muller | |
| 2018/0231361 | A1 | 8/2018 | Wicks et al. | |

FOREIGN PATENT DOCUMENTS

| | | | |
|---|---|---|---|
| AU | 2005207595 | B2 | 2/2011 |
| AU | 2004290356 | B8 | 5/2011 |
| AU | 2013373154 | A1 | 7/2015 |
| AU | 2015280721 | B2 | 7/2021 |
| CN | 1030824 | A | 2/1989 |
| CN | 2662195 | Y | 12/2004 |
| CN | 101464117 | B | 1/2013 |
| DE | 1806214 | A1 | 7/1969 |
| DE | 3131332 | A1 | 4/1982 |
| EP | 0207749 | A2 | 1/1987 |
| EP | 0208480 | B1 | 3/1992 |
| EP | 1859225 | B1 | 4/2015 |
| GB | 577169 | A | 5/1946 |
| JP | S59137800 | A | 8/1984 |
| JP | H05346300 | A | 12/1993 |
| JP | 2001127511 | A | 5/2001 |
| JP | 2001153598 | A | 6/2001 |
| JP | 2001330400 | A | 11/2001 |
| WO | WO-9208932 | A1 | 5/1992 |
| WO | WO-0159401 | A1 | 8/2001 |
| WO | WO-2005052498 | A1 | 6/2005 |
| WO | WO-2006010172 | A1 | 1/2006 |
| WO | WO-2006047823 | A1 | 5/2006 |
| WO | WO-2006096920 | A1 | 9/2006 |
| WO | WO-2007124538 | A1 | 11/2007 |

(56) References Cited

FOREIGN PATENT DOCUMENTS

| | | | | |
|---|---|---|---|---|
| WO | WO-2007124539 | A1 | 11/2007 | |
| WO | WO-2008055274 | A1 | 5/2008 | |
| WO | WO-2008078288 | A1 | 7/2008 | |
| WO | WO-2009143585 | A1 | 12/2009 | |
| WO | WO-2010085837 | A1 | 8/2010 | |
| WO | WO-2012061850 | A1 | 5/2012 | |
| WO | WO-2012149277 | A2 | 11/2012 | |
| WO | WO-2013044275 | A1 | 3/2013 | |
| WO | WO-2014197020 | A1 | 12/2014 | |
| WO | WO-2023027639 | A1 * | 3/2023 | ..... F42D 1/055 |

OTHER PUBLICATIONS

Bird. N E et al., "Safety and security—minimising risk with electronic detonators", 2005, pp. 435-444.
Extended European Search Report mailed on Apr. 2, 2019, for European Application No. EP 15812555.9, 9 pages.
International Search Report in International Application No. PCT/SG2015/050322 mailed on Oct. 27, 2015, 5 pages.
Latimer, "Initiating the future of blasting", Australian Mining, Aug. 2010, 1 page.
Lovitt, "Single Shot Drawbell Blasting with Electronic Detonators at Freeport", International Society of Explosives Engineers, 2004, 14 pages.
Lownds, "Safety of Blasting with Electronic Detonators", ISEE Meeting, 2008, 11 pages.
No Author Available) "Electronic detonators 1992-2007" T T, DELTADET, 6 pages.
No Author Available), "World first commercial wireless initiating system", Orica website, retrieved online Feb. 8, 2023, 1 page.
Woodhall, M., "Centralized wireless remote blasting", Third International Platinum Conference 'Platinum in Transformation', The Southern African Institute of Mining and Metallurgy, 2008, pp. 129-133.
Anderson, "Computers in geology, geometry, planning, training, communications . . . . " E&MJ—Engineering & Mining Journal, vol. 197, No. 7, Jul. 1996, pp. 34+. Gale General OneFile, link.gale.com/apps/doc/A18622040/ITOF?u=slnsw_public&sid=bookmark-ITOF&xid=7800f1ff. Accessed Jun. 28, 2022, 8 pages.
Broome, "Australian equipment and services." Mining Magazine, vol. 181, No. 4, Oct. 1999, pp. 238+. Gale Academic OneFile, link.gale.com/apps/doc/A57386909/AONE?u=slnsw_public&sid=bookmark-AONE&xid=451cd514. Accessed Jun. 28, 2022, 9 pages.
Carter, "Making the connection" Engineering & Mining Journal, Mar. 2001, vol. 202, Issue 3, p. 28. 5p. 3 Color Photographs, 12 pages.
Caruana, "No Title Available" Coal Markets, Jul. 22, 2010, 2 pages.
Deacon, "Progress with computer aided blasting using (in-hole) programmable electronic delay detonators" CRC Press, 1st Edition, 1996, 2 pages.
Dent, "Electrodet ® A New Precise, Reliable, Easy to Use and Cost Effective Electronic Delay Detonator System" International Society of Explosives Engineers, Jul. 9-14, 1994, 15 pages.
Dozolme et al., "Ultimate Technologica Combination in Electronic Blasting, A Conclusive Contribution to Blasters' Health & Safety" 2006 International Society of Explosives Engineers, 18 pages.
Dozolme et al., "Wireless programmable blasting—3 year track record" Brighton Conference Proceedings 2005, R. Holmberg et al., 2005 European Federation of Explosives Engineers, 6 pages.
Fensham, "ExEx 2000 SMARTDET Electronic Intiation System—An Effective, Easy to Use, Initiation System" Explo '99, Kalgoorlie, WA, Nov. 7-11, 1999, 7 pages.
Givens et al., "Advantages of EFI Based Detonator Technology in Commercial Blasting Applications" International Society of Explosives Engineers, 2011, 15 pages.
Givens et al., "Advantages of EFI Based Detonator Technology in Commercial Blasting Applications" International Society of Explosives Engineers, 2011, abstract only, 1 page.
Hammelmann et al., "Electronic blasting and blast management" Explosives and Blasting Technique, Holmberg (ed.), Swets & Zeitlinger, 2003, 5 pages.
Holmberg, "Explosives and Blasting Technique" Explosives and Blasting Technique, Holmberg (ed.), Swets & Zeitlinger, 2003, 14 pages.
Holmberg, "Third EFEE World Conference on Explosives and Blasting" Brighton Conference Proceedings, 2005, European Federation of Explosives Engineers, 14 pages.
Hummel et al., "A centralised digital blasting system" Explosives and Blasting Technique, Holmberg (ed.), Swets & Zeitlinger, 2003, 5 pages.
Hummel et al., "A digital surface remote blasting system" Brighton Conference Proceedings, 2005, European Federation of Explosives Engineers, 4 pages.
Jones, "Fourth Southern African Base Metals Conference" Africa's Base Metals Resurgence, Swakopmund, Namibia, Jul. 23-25, 2007, 2008, 3 pages.
Jones, "Third International Platinum Conference" 'Platinum in Transformation', Sun City, South Africa, Oct. 5-9, 2008, 2008-2009, 3 pages.
Kononov et al., "Very Low Frequency Technology and ITS Integration Into the Contemporary RFID and Other Mining Systems" (No Publication Date), 7 pages.
Kricak et al., Sequential Blasting Initiation System With RF Control (SBIS-RF), International Society of Explosives Engineers, 2008, vol. 2, 8 pages.
Latimer, "Initiating the future of blasting", Australian Mining, Aug. 2010, 5 pages.
Latimer, The seven month itch Australian Mining, Aug. 2010, 5 pages.
Latimer, "World first commercial wireless initiating system" Australian Mining, Jul. 20, 2010, 2 pages.
Lovitt et al., "Single shot drawbell blasting with Orica's i-kon® detonators at Freeport" Explosives and Blasting Technique, Holmberg (ed.), Swets & Zeitlilnger, 2003, 9 pages.
Lownds et al., "Safety of Blasting With Electronic Detonators" SME Annual Meeting, Feb. 28-Mar. 3, 2010, 6 pages.
Moser et al., "Fifth EFEE World Conference on Explosives and Blasting" Budapest Conference Proceedings, European Federation of Explosives Engineers, 2009, 12 pages.
No Author Available, 1 page background describing initial devices that are used in rock blasting, (No Publication Date), 2 pages.
No Author Available, "Safety Equipment" Canadian Mining Journal, 2005, ProQuest Central, p. 113, 5 pages.
No Author Available, "Safety requires remote blast initiation" Australian Mining, Oct. 2000, 3 pages.
No Author Available, "Algerian Mining Supplement" Mining Magazine, vol. 189, No. 2, Aug. 2003, 5 pages.
No Author Available, "Australian technology and know-how featured at Aimex." E&MJ—Engineering & Mining Journal, vol. 196, No. 10, Oct. 1995, pp. 50+. Gale General OneFile, link.gale.com/apps/doc/A17629950/ITOF?u=slnsw_public&sid=bookmark-ITOF&xid=e35d11f1. Accessed Jun. 28, 2022., 6 pages.
No Author Available, "Automation and Communications" Canadian Mining Journal, 2005, ProQuest Central, p. 14, 8 pages.
No Author Available, "Blasting without firing cables." World Mining Equipment, vol. 19, No. 7, Sep. 1995, pp. 19+. Gale General OneFile, link.gale.com/apps/doc/A17437067/ITOF?u=slnsw_public&sid=bookmark-ITOF&xid=df7be958. Accessed Jun. 28, 2022, 3 pages.
No Author Available, BlastPED Installation Descriptions, The Wayback Machine, (No Publication Date), 2 pages.
No Author Available, "BlastPED: Remote blasting revolutionizes mine operations" Engineering and Mining Journal, May 1998, 199, 5, ProQuest Central, p. 78, 2 pages.
No Author Available, BlastPED System, EXEL Version, Mine Site Technologies, 2001, The Wayback Machine, 3 pages.
No Author Available, BlastPED System, LF Version, Mine Site Technologies, 2001, The Wayback Machine, 5 pages.
No Author Available, BlastPED System, PED Version, Mine Site Technologies, 2001, The Wayback Machine, 5 pages.

(56) References Cited

OTHER PUBLICATIONS

No Author Available, BlastPED System, System Overview, Mine Site Technologies, 2001, The Wayback Machine, 2 pages.
No Author Available, "Boddington gold at the cross roads" Australian Mining, vol. 91, No. 2, Mar. 1999, 3 pages.
No Author Available, "breaking new ground, Considerations in regard to the safety of RF shotfiring equipment" African Explosives Limited, (No Publication Date), 9 pages.
No Author Available, "Comments re U.S. Patent Application No. 2013/0125772 (US'772 Backhus)" (No Publication Date), 33 pages.
No Author Available, "Comments re U.S. Patent Application No. 2014/0053750 (US'750 Lownds)" (No Publication Date), 25 pages.
No Author Available, "Comments re U.S. Pat. No. 4,860,653 (US'653 Abouav)" (No Publication Date), 32 pages.
No Author Available, "Comments re U.S. Pat. No. 7,778,006 (US'006 Stewart)" (No Publication Date), 29 pages.
No Author Available, "Equipment and services from down under." E&MJ—Engineering & Mining Journal, vol. 200, No. 9, Sep. 1999, pp. 23WWW+. Gale General OneFile, link.gale.com/apps/doc/A57386547/ITOF?u=slnsw_public&sid=bookmark-ITOF&xid=5ab86551. Accessed Jun. 28, 2022, 5 pages.
No Author Available, "Explosives Act 1999" Queensland, Current as at Dec. 5, 2024, 159 pages.
No Author Available, "HotShot™ Module 2, HotShot™ system overview" HotShot Electronic Detonator System, User Manual, Revision 01, DetNet South Africa, 2004, 24 pages.
No Author Available, SmartShot™ Module 2, SmartShot™ system overview, SmartShot Electronic Detonator System, User Manual, Revision 1, DetNet South Africa, 2006, 31 pages.
No Author Available, "Mining explosives group buys electro-detonator firm" Mar. 27, 2003, 4 pages.
No Author Available, "On Solid Ground" Orica, 2010 Business Overview, 26 pages.
No Author Available, PED System, Antenna Installations, Mine Site Technologies, 2001, The Wayback Machine, 4 pages.
No Author Available, PED System, BLASTPED, Mine Site Technologies, 2001, The Wayback Machine, 3 pages.
No Author Available, PED System, Mine Site Technologies, 2001, The Wayback Machine, 2 pages.
No Author Available, PED System, System Overview, Mine Site Technologies, 2001, The Wayback Machine, 5 pages.
No Author Available, "Product & Process News" Mining Magazine, Mar. 2001, p. 163, 2 pages.
No Author Available, "ULF paging system accepted in Canada" Canadian Mining Journal, Oct. 2002, 123, 7, ProQuest Central p. 28, 2 pages.
No Author Available, "Underground Blasting Without Firing Cables" MIMAG, Jun. 1994, 4 pages.
No Author Available, "Underground communications." Mining Magazine, vol. 181, No. 4, Oct. 1999, pp. 254+. Gale Academic OneFile, link.gale.com/apps/doc/A57386910/AONE?u=slnsw_public&sid=bookmark-AONE&xid=07b54b21. Accessed Jun. 28, 2022, 5 pages.
No Author Available, "World's first commercial wireless initiating system unveiled" Orica, Feb. 4, 2011, 3 pages.
Orbell, "New Blasting Initiation Technologies in the Mining Industry" The AusIMM New Leaders' Conference, Brisbane, QLD, Apr. 28-29, 2005, 9 pages.
Potts, "Any time, any place, anywhere; Advances in communications systems for the mining industry" World Mining Equipment, Jan./Feb. 2000, 6 pages.
Potts, "Fighting back! The instability of the national currency means that Australian and overseas mines are able to pick up economically prices, high-quality products made in Oz. Local manufacturers of mining equipment are taking advantage of this." Australian technology, World Mining Equipment, Jan./Feb. 2001, 5 pages.
Pretorius, "Digitally Integrating the Blast Design with Remote Wireless Electronic Blasting" International Society of Explosives Engineers, 2005, vol. 2, 11 pages.
Suzuki et al., "Development of the Remote Controlled Blasting System for Tunnel Construction" International Society of Explosives Engineers, 2000, 10 pages.
Teowee et al., "RF Susceptibility of Electronic Detonators" International Society of Explosives Engineers, 2009, vol. 1, 12 pages.
Tshipa, "Safe, Secure Wireless Blast Initiation System" The Southern African Institute of Mining and Metalurgy, Surface Mining, 2008, 5 pages.
U.S. Appl. No. 60/795,568, Ronald F. Stewart, filed Apr. 28, 2006, 39 pages.
U.S. Appl. No. 60/813,361, Ronald F. Stewart, filed Apr. 28, 2006, 61 pages.
Van Wyk et al., "Safe and Reliable Remote Blasting with Electronic Initiation Systems" International Society of Explosives Engineers, 2011, 11 pages.
Van Wyk et al., "External Influences on Electronic Detonator Blasting Systems and how to Protect Against such Influences" Explo Conference, Melbourne, VIC, Nov. 8-9, 2011, 8 pages.
Van Wyk et al., "The influence of electromagnetic waves in blasting with specific reference to wireless remote firing" Budapest Conference Proceedings, European Federation of Explosives Engineers, 2009, 10 pages.
Voss, "Byte sized" World Mining Equipment, Jan./Feb. 2001, 4 pages.
Woodhall, "Remote Mine Wide Communications" The Southern African Institute of Mining and Metallurgy, The Fourth Southern African Conference on Base Metals, (No Publication Date), 11 pages.
Woof, "Technology downunder; Australia is a leading source for a wide array of leading-edge mining technology—Mike Woof reports on some of the latest developments" World Mining Equipment, Jan./Feb. 2002, 9 pages.

* cited by examiner

WIRELESS INITIATION DEVICE

CROSS REFERENCE TO RELATED APPLICATION

This application is a continuation of U.S. patent application Ser. No. 15/761,061, filed Mar. 16, 2018, which is a U.S. national phase application of International PCT Patent Application No. PCT/SG2015/050322, filed Sep. 16, 2015, which applications are incorporated herein by reference in their entirety.

FIELD OF THE INVENTION

The present invention relates generally to a wireless initiation device for use in commercial, civil rock blasting applications. The present invention also relates generally to a primer, an initiation system, a method of assembling a wireless initiation device, a method of blasting rock, and/or a method of transporting a wireless initiation device.

BACKGROUND

Initiation devices that are used in rock blasting are often exposed to dynamic shock pressure during a blast. A blast in one blast hole can generate shock pressures in adjacent blast holes, or adjacent decks within the same blast hole of the order of 100 MPa. Furthermore, the adjacent holes/decks can be subjected to accelerations of the order of 50,000 $m/s^2$. These pressures and accelerations can damage an electronic initiation device, resulting in either a misfire or premature detonation.

Other features in blast holes that can negatively impact deployed initiation devices include pressure, ground or other water or other liquids, and other blast hole contents, such as bulk explosive compositions. To minimize the likelihood of damage to devices, specially designed detonator housings, and/or internal protection can be provided.

Wireless initiation devices for commercial blasting applications typically include a power source (such as a battery), a signal receiver (for example, an antenna and associated electronics) and processor that synchronizes all devices to a master signal (among other activities), a timing circuit, and a fuse head and base charge. A base charge connected to a power source prior to deployment into a borehole has a risk of inadvertent detonation. Connecting the base charge to a booster amplifies the energy of the base charge to initiate a bulk explosive charge within a blast hole.

Devices of this type are required to discharge initiation energy, and hence are often classified as a hazardous good, which requires compliance with governmental and safety agency requirements, as well as specialized transport and storage.

In order to decrease the costs of housing components in a shock-resistant manner and the costs of transport and storage of hazardous elements of initiation devices, new methods of initiation device construction are needed. Accordingly, it is desired to address the above, and/or at least provide a useful alternative.

SUMMARY OF THE INVENTION

The present invention provides a wireless initiation device, comprising:

a power source, a processing module for processing wireless electromagnetic communications signals received by an electromagnetic receiver system associated with the processing module, the wireless electromagnetic communications signals including a wireless electromagnetic communications signal representative of a FIRE command, the processing module being configured to generate an initiation signal upon receipt of the FIRE command;

a first housing within which at least one of the power source and the processing module is disposed, the first housing having a first connector; and an initiation unit having a second housing within which is disposed an initiation module that is configured to discharge initiation energy sufficient to initiate an explosive charge associated with the device, the initiation module being connected to, or connectable with, the processing module such that initiation module can receive an initiation signal from the processing module, and a second connector that can be mated with the first connector, thereby connecting the first and second housings, wherein the initiation module is configured to execute a sequence upon receipt of the initiation signal, the sequence resulting in discharge of initiation energy from the initiation unit.

The wireless initiation device can further comprise the electromagnetic receiver system, wherein the power source and electromagnetic receiver system are disposed in the first housing.

The present invention provides a wireless initiation device, comprising:

a head unit having a first housing within which is disposed a power source, at least part of an electromagnetic receiver system, and a processing module for processing wireless electromagnetic communications signals receivable by the electromagnetic receiver system that include a wireless electromagnetic communications signal representative of a FIRE command, the head unit having a first communication interface to which the processing module is connected, the processing module being configured to generate and transmit an initiation signal to the first communication interface upon receipt of the FIRE command; and an initiation unit having a second housing within which is disposed a base charge, and an initiation module that includes an electronic circuit configured to cause initiation of the base charge, the initiation unit having a second communication interface to which the initiation module is connected, and which is connectable with the first communication interface to bring the processing module into electronic communication with the initiation module, and the electronic circuit is configured to execute a sequence independently of the head unit upon receipt of the initiation signal, the sequence resulting in initiation of the base charge.

The present invention provides a wireless initiation device, comprising:

a head unit having a first housing within which is disposed a power source, a processing module for processing wireless electromagnetic communications signals received by an electromagnetic receiver system associated with the processing module, the wireless electromagnetic communications signals including a wireless electromagnetic communications signal representative of a FIRE command, the head unit having a first communication interface to which the processing module is connected, the processing module being configured to generate and transmit an initiation signal to the first communication interface upon receipt of the FIRE command; and an initiation unit having a second housing within which is disposed an initiation module, the initiation unit being configured to discharge initiation energy sufficient to initiate an explosive charge associated with the device, the initiation unit having a second communication interface to which the initiation module is connected, and which is connectable with the first communication interface thereby bringing the processing module into electronic communication with the initiation module, and the initiation module is further configured to execute a sequence independently of the head unit upon receipt of the initiation signal, the sequence resulting in discharge of initiation energy from the initiation unit.

Preferably, the first housing has a first connector, and the second housing has a second connector that can be mated with the first connector to connect the head and initiation units.

In some embodiments, the first communication interface includes a first set of terminals, and the second communication interface includes a second set of terminals, and wherein the first and second sets of terminals are interconnected to bring the processing module into electronic communication with the initiation module.

Preferably, mating the first and second connectors connects the first and second sets of terminals.

In some embodiments, the diameter of the second housing is equal to the diameter of the first housing. In other embodiments, the diameter of the second housing is less than the diameter of the first housing.

In at least some embodiments, the second housing is able to sustain greater shock pressures without failing than the first housing.

In some embodiments:

the head unit has a third set of terminals to which the power source is connected, and which provide an open circuit between the power source and the processing module; and the initiation unit has a fourth set of terminals that are connected to a closing circuit, such that third and fourth sets of terminals are connectable to close the open circuit.

Preferably, mating the first and second connectors connects the third and fourth sets of terminals.

In some alternative embodiments, the head unit has a switch that interrupts current flow between the power source and the processing module. Preferably, the switch is normally open, and is closed when the first and second sets of terminals are connected. Alternatively or additionally, the switch is normally open, and is closed when the first and second connectors are mated to one another.

Preferably, the processing module is configured to enable programming of a delay period between transmission of the initiation signal and discharge of initiation energy, and the processing module is configured to generate and transmit a delay signal to the first set of terminals, the delay signal being representative of the delay period, and the initiation module is configured to include the delay period in the sequence upon receipt of a delay signal.

In some embodiments, programming of the delay period occurs by transmission of data from an encoding machine.

In some alternative embodiments, programming of the delay period occurs by transmission of one or more wireless electromagnetic communications signals from a blasting machine that are receivable by the electromagnetic receiver system.

Preferably, the wireless electromagnetic communications signals include a wireless electromagnetic communications signal representative of an ARM command, and the processing module is configured to generate and transmit an energization signal to the first set of terminals upon receipt of the ARM command, and the initiation unit is configured to energize part of the initiation module in preparation for discharge of initiation energy upon receipt of an initiation signal.

In some embodiments, the initiation unit includes a base charge that discharges initiation energy by detonation, the base charge is disposed within the second housing, and the initiation module is configured to cause detonation of the base charge. The initiation module can further include an electronic circuit that is brought into electronic communication with the head unit via the first and second communication interfaces, and the electronic circuit is configured to execute the sequence that results in detonation of the base charge.

In some alternative embodiments, the initiation unit includes a base charge that discharges initiation energy by detonation, the base charge being connected to the initiation module by an electrically conductive lead such that the base charge can be spaced from the head unit, wherein the initiation module is configured to cause detonation of the base charge.

The electronic circuit can include a timing circuit to effect the delay period in the sequence.

Preferably, the head unit includes an electromagnetic receiver system for receiving the wireless electromagnetic communications signals, the electromagnetic receiver system is connected to the processing module, and at least part of the electromagnetic receiver system is disposed within the first housing. More preferably, the electromagnetic receiver system is wholly disposed within the first housing.

In some embodiments, the head unit further has a fifth set of terminals to which the processing module is connected, the processing module being configured to generate and transmit an initiation signal to the fifth set of terminals upon receipt of the FIRE command, the first and fifth sets of terminals being arranged at opposing ends of the first housing, and the device further comprises a second initiation unit that includes a second initiation module, the second initiation unit being configured to discharge initiation energy sufficient to initiate an explosive charge associated with the device, the second initiation unit having a sixth set of terminals to which the second initiation module is connected, and which are connectable to the fifth set of terminals thereby bringing the processing module into electronic communication with the second initiation module, and the second initiation module is further configured to execute a sequence independently of the head unit upon receipt of the initiation signal, the sequence resulting in discharge of initiation energy from the initiation unit.

The present invention also provides a primer comprising:

a wireless initiation device as previously described;

a third connector that is provided on one of the first or second housings; and a booster that has a complementary connector to mate with the third connector, the booster includes a confined explosive material that is initiated by the initiating energy discharged from the initiation unit.

In certain embodiments, the third connector is provided on the first housing.

Preferably, the third connector is arranged such that the initiation unit is received within the booster when the third connector is mated to the complementary connector.

Preferably, the primer further includes an attachment point to which a tether can be attached to facilitate lowering the primer into a blast hole.

In certain embodiments, the first housing further has a fourth connector, and the primer further comprises a supplementary booster that has a complementary connector to mate with the fourth connector. In some embodiments, the booster and the supplementary booster are connected by a detonating device, such that the detonation device is detonated by the booster, which causes detonation of the supplementary booster. In one example, the detonating device is detonating cord that extends between the booster and the supplementary booster.

In some embodiments, the head unit has a pair of first sets of terminals, and the processing module is configured to generate and transmit initiation signals to both first sets of terminals, and the primer further comprises two initiation units that are each connectable to a respective one of the pairs of first sets of terminals.

In embodiments in which the wireless initiation device comprises two initiation units, the fourth connector may be arranged such that one of the initiation units is received within the supplementary booster when the fourth connector is mated to the complementary connector of the supplementary booster.

The present invention provides a wireless initiation device, comprising:

a power source, a processing module for processing wireless electromagnetic communications signals received by an electromagnetic receiver system associated with the processing module, the wireless electromagnetic communications signals including a wireless electromagnetic communications signal representative of a FIRE command, the processing module being configured to generate an initiation signal upon receipt of the FIRE command; and an initiation module that is configured to discharge initiation energy sufficient to initiate an explosive charge associated with the device, the initiation module being connected to, or connectable with, the processing module such that initiation module can receive an initiation signal from the processing module, wherein the initiation module is configured to execute a sequence independently of the processing module and power source upon receipt of the initiation signal, the sequence resulting in discharge of initiation energy from the initiation module.

The present invention also provides a head unit for a wireless initiation device, the head unit comprising a housing within which is disposed:

a power source;

a processing module for processing wireless electromagnetic communications signals that are received by an electromagnetic receiver system that is associated with the processing module, the wireless electromagnetic communications signals including a wireless electromagnetic communications signal representative of a FIRE command, wherein the head unit further comprises:

a connector formed in the housing that mates with a complimentary connector on an initiation unit housing to mate the head unit to the initiation unit housing, and a communication interface to which the processing module is connected, and the processing module is configured to generate and transmit an initiation signal to the communication interface upon receipt of the FIRE command, whereby, when the initiation unit is connected to the head unit, the processing module is in electronic communication with the initiation unit via the communication interface, and a corresponding communication interface provided in the initiation unit.

In at least some embodiments, the communication interface is a set of terminals to which the processing module is connected, whereby when the initiation unit is connected to the head unit, the processing module is in electronic communication with the initiation unit via the set of terminals, and a set of complimentary terminals provided in the initiation unit.

The present invention also provides a head unit for a wireless initiation device, the head unit comprising a housing within which is disposed:

a power source;

a processing module for processing wireless electromagnetic communications signals that are received by an electromagnetic receiver system that is associated with the processing module, the wireless electromagnetic communications signals including a wireless signal representative of a FIRE command, wherein the head unit further comprises:

a first connector formed at a first end of the housing that mates with a complimentary connector on a first initiation unit housing to mate the head unit to the first initiation unit housing, and a second connector formed at a second end of the housing that mates with a complimentary connector on a second initiation unit housing to mate the head unit to the second initiation unit housing, and two communication interfaces to which the processing module is connected, and the processing module is configured to generate and transmit an initiation signal to each of the communication interfaces upon receipt of the FIRE command, whereby, when each of the first and second initiation units is connected to the head unit, the processing module is in electronic communication with the respective first or second initiation unit via a respective one of the two communication interfaces.

In at least some embodiments, each of the communication interfaces is a set of terminals to which the processing module is connected, whereby when the each of the first and second initiation units is connected to the head unit, the processing module is in electronic communication with the respective first or second initiation unit via one of the sets of terminals, and a set of complimentary terminals provided in the respective first or second initiation unit.

Preferably, the head unit further comprises an electromagnetic receiver system for receiving the wireless electromagnetic communications signals, wherein the electromagnetic receiver system is connected to the processing module, and at least part of the electromagnetic receiver system is contained in the first housing.

The present invention also provides an initiation unit for a wireless initiation device that includes a head unit that has a first connector and a first communication interface, the initiation unit comprising:

a housing within which is disposed an initiation module that is configured to discharge initiation energy sufficient to initiate an explosive charge associated with the initiation unit;

a second connector that mates with the first connector; and a second communication interface to which the initiation module is connected, the second communication interface being connectable with the first communication interface of a head unit such that the initiation module can receive electronic communication from the head unit, the electronic communication including an initiation signal, wherein the initiation module is configured to execute a sequence independently of the head unit upon receipt of the initiation signal from the head unit, the sequence resulting in discharge of initiation energy from the initiation unit.

In some embodiments, the first communication interface includes a first set of terminals, and the second communication interface includes a second set of terminals, and wherein the first and second sets of terminals are connectable with one another to bring the processing module into electronic communication with the initiation module.

In one embodiment, the initiation module includes a base charge that detonates to discharge the initiation energy, the base charge is disposed within the housing, and the initiation module is configured to cause detonation of the base charge. The initiation module can further include an electronic circuit that is brought into electronic communication with the head unit via the first and second sets of terminals, and the electronic circuit is configured to execute the sequence, which results in discharge of initiation energy from the initiation unit.

The housing may consist of a first portion that includes the second connector, and a second portion in which the base charge is disposed, and the initiation unit may further comprise an electrically conductive lead that extends between the first and second portions of the housing, such that the base charge can be spaced from the head unit. In one arrangement, the lead connects the second set of terminals to the initiation module. In an alternative arrangement, the lead connects the initiation module to the base charge.

The present invention also provides an initiation system for initiating bulk explosive charges in a plurality of blast holes, the system comprising:

a plurality of primers as previously described;

a blasting machine that is configured to transmit wireless electromagnetic communications signals for reception by the wireless initiation device of each of the primers, the wireless electromagnetic communications signals including a wireless electromagnetic communications signal representative of a FIRE command;

wherein, upon receipt of the FIRE command, the initiation module of each device executes a sequence independently of the head unit of that device and the blasting machine, the sequence resulting in discharge of initiation energy from that initiation unit.

The initiation system can further comprise an encoding machine that, when coupled with each of the wireless initiation devices, is operable to program the respective wireless initiation device.

The present invention also provides a method of preparing a wireless initiation device for deployment into a blast hole, the method comprising:

providing a head unit having a first housing within which is disposed a power source, and a processing module for processing wireless electromagnetic communications signals receivable by an electromagnetic receiver system associated with the processing module, the wireless electromagnetic communications signals including a wireless electromagnetic communications signal representative of a FIRE command, the head unit having a first communication interface to which the processing module is connected;

providing an initiation unit having a second housing within which is disposed an initiation module that is configured to discharge initiation energy sufficient to initiate an explosive charge associated with the device, the initiation unit having a second communication interface to which the initiation module is connected; and arranging the head unit and initiation unit such that the processing module and the initiation module are in electronic communication via the first and second communication interfaces, whereby, upon receipt of the wireless electromagnetic communications signal representative of a FIRE command, the processing module generates and transmits an initiation signal to the initiation module, such that the initiation unit then executes a sequence independently of the head unit, the sequence resulting in discharge of initiation energy from the initiation unit.

In some embodiments, the first communication interface includes a first set of terminals, and the second communication interface includes a second set of terminals, and wherein the step of arranging the head unit and initiation unit involves connecting the first and second sets of terminals to one another to bring the processing module into electronic communication with the initiation module.

Preferably, connection of the first and second sets of terminals occurs within a mine site that includes the blast hole. More preferably, connection of the first and second sets of terminals occurs adjacent the collar of the blast hole.

The method can further involve coupling the wireless initiation device to an encoding machine, and programming the wireless initiation device. Coupling the wireless initiation device may occur before or after the first and second sets of terminals are connected.

The present invention also provides a method of blasting rock at a site, the method comprising:

forming a blast hole in the rock;

providing a wireless initiation device that has a power source; a processing module for processing wireless electromagnetic communications signals received by an electromagnetic receiver system associated with the processing module; a first housing within which at least one of the power source and the processing module is disposed, the first housing having a first connector; and an initiation unit having a second housing within which is disposed an initiation module that is configured to discharge initiation energy, the second housing having a second connector that mates with the first connector to connect the first and second housings;

assembling the wireless initiation device at the site, including mating the first and second connectors to connect the first housing to the second housing;

connecting the wireless initiation device to a booster that includes a confined explosive material that is to be initiated by initiating energy discharged from the initiation unit to form a primer;

placing the primer in the blast hole;

loading a bulk explosive material into the blast hole; and sending a wireless electromagnetic communications signal representative of a FIRE command from a blasting machine, whereby, upon the electromagnetic receiver system receiving the wireless electromagnetic communications signal representative of the FIRE command, the processing module generates an initiation signal and transmits the initiation signal to the initiation module, and upon receipt of the initiation signal the initiation module executes a sequence that results in discharge of initiation energy from the initiation unit to initiate the confined explosive material, which initiates the bulk explosive material.

Preferably, the assembling step occurs adjacent the blast hole. In one embodiment, the blast hole is formed on a bench at the site, and the assembling step occurs on the bench. In one alternative embodiment, the blast hole is formed from within an underground tunnel at the site, and the assembling step occurs within that tunnel. More preferably, the assembling step occurs at the collar of the blast hole.

The method can further involve programming the wireless initiation device. The programming step may include coupling the wireless initiation device to an encoding machine that is operable to transmit programming data to the wireless initiation device.

Preferably, the programming step occurs adjacent the blast hole. In one embodiment, the blast hole is formed on a bench at the site, and the programming step occurs on the bench. The programming step may occur before or after the assembling step.

The present invention also provides a method of transporting a wireless initiation device to a mine site, the wireless initiation device having a power source; a processing module for processing wireless electromagnetic communications signals received by an electromagnetic receiver system; a first housing within which at least one of the power source and the processing module is disposed, the first housing having a first connector; and an initiation unit having a second housing within which is disposed an initiation module that is configured to discharge initiation energy, the second housing having a second connector that mates with the first connector to connect the first and second housings, the method comprising:

transporting the wireless initiation device such that the initiation unit is spatially separated from the power source during transport.

In one embodiment, transporting the wireless initiation device involves transporting the initiation unit in a first shipment to the mine site, and transporting the power source in a second shipment to the mine site.

In at least some embodiments, the wireless initiation device includes a head unit that consists of the first housing within which the power source and the processing module are disposed, and transporting the device involves transporting the initiation unit in a first shipment to the mine site, and transporting the head unit in a second shipment to the mine site.

BRIEF DESCRIPTION OF THE DRAWINGS

In order that the invention may be more easily understood, embodiments will now be described, by way of example only, with reference to the accompanying drawings, in which.

DETAILED DESCRIPTION

Figure 1:
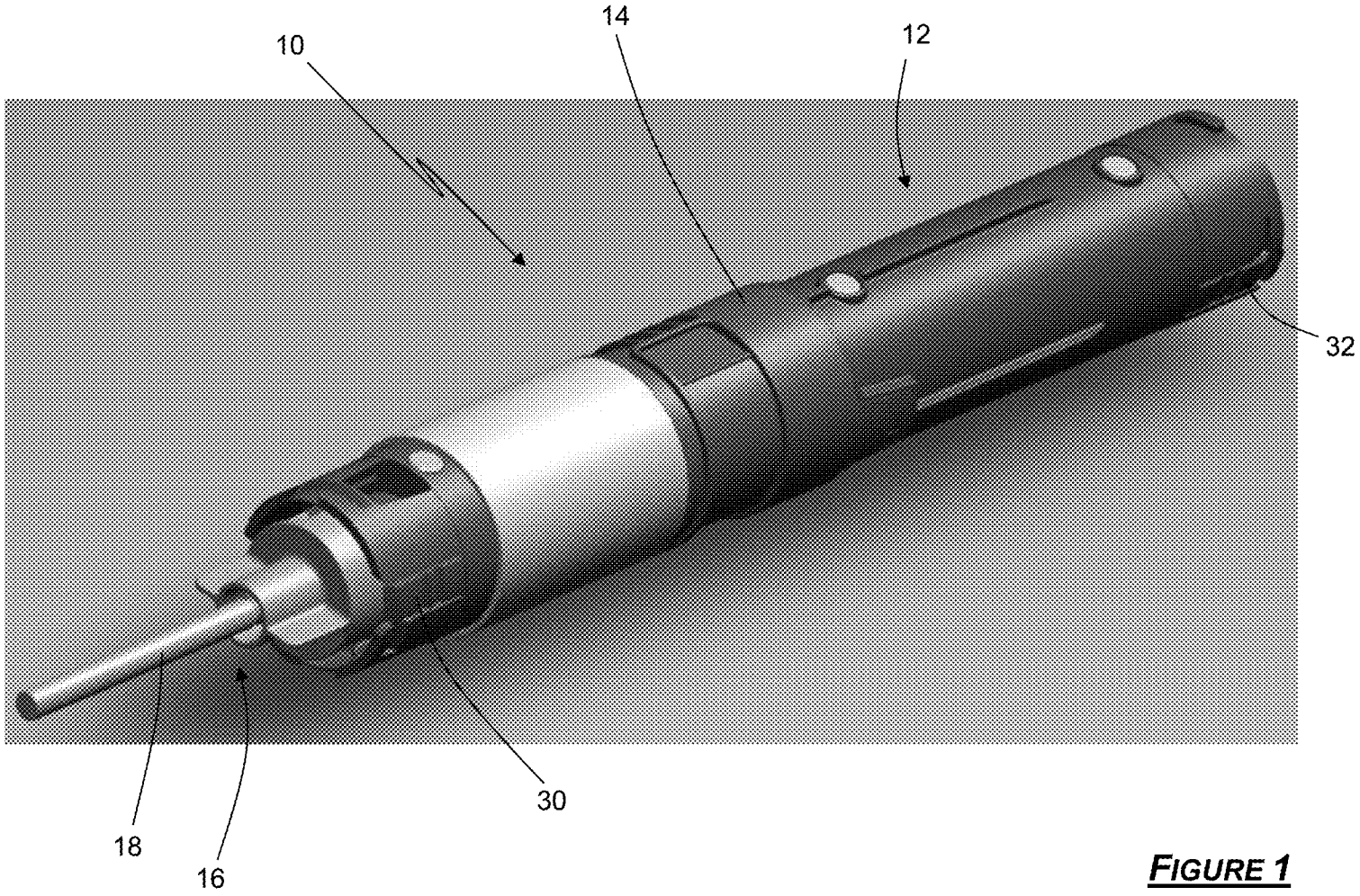
FIG. 1: is a perspective view of a wireless initiation device according to a first embodiment of the present invention.

FIGS. 1 to 5 show a wireless initiation device 10 that is for use in initiating a bulk explosive charge in a blast hole formed in rock. The device 10 has a head unit 12 that has a first housing 14, and an initiation unit 16 that has a second housing 18. The initiation unit 16 is shown in further detail in FIGS. 2 and 3, and the head unit 12 is shown in further detail in FIG. 4.

Within the first housing 14, the head unit 12 has a power source for providing electrical power, and a processing module 36. Wireless electromagnetic communications signals (hereinafter referred to simply as "wireless signals") are receivable by an electromagnetic receiver system, which in this embodiment is in the form of an antenna 38, the wireless signals being transmitted to the processing module 36. The head unit 12 further has a first communications interface to which the processing module 36 is connected. In this embodiment, the first communications interface is in the form of a first set of terminals 40. The power source may be a battery 34. In this embodiment, the antenna 38 is also within the first housing 14, and the antenna 38 is connected to the processing module 36. In this embodiment, the antenna 38 is a tri-axial coil antenna that has three coils 38*a*, 38*b*, 38*c* mounted orthogonally with respect to each other, within the first housing 14.

Within the second housing 18, the initiation unit 16 has an initiation module 20 that is configured to cause discharge of initiation energy from the initiation unit 16. The initiation unit 16 further has a second communications interface to which the initiation module 20 is connected. In this embodiment, the second communications interface is in the form of a second set of terminals 22. (For succinctness, sets of terminals, when referred to together, are hereinafter referred to as "terminals") The second terminals 22 are connectable to the first terminals 40 to bring the processing module 36 into electronic communication with the initiation module 20.

When the initiation unit 16 is associated with explosive material, the discharge of initiation energy is sufficient to cause explosive material to detonate. The explosive material may be confined within a booster, as discussed in detail below.

In this particular embodiment, the initiation module 20 includes an electronic circuit, and a base charge 42. The electronic circuit is configured to initiate the base charge 42, as will be discussed in further detail in connection with FIG. 8.

When the first and second terminals 40, 22 are connected and the device 10 receives, via the antenna 38, a wireless signal representing a FIRE command, the processing module 36 generates and transmits an initiation signal to the first terminals 40. The initiation signal is transferred to the initiation module 20 via the connection between the first and second terminals 40, 22. Upon receipt of that initiation signal the electronic circuit executes a sequence independently of the head unit 12, the sequence resulting in discharge of initiation energy, which in this embodiment occurs by detonation of the base charge 42.

Thus, once the initiation unit 16 has received an initiation signal from the head unit 12, the initiation unit 16 acts independently of the head unit 12 to initiate the base charge 42. Damage to any part of the head unit 12 after the initiation signal has been issued is unlikely to affect the performance of the initiation unit 16. In other words, the base charge 42 is unlikely to misfire or prematurely detonate as a result of such damage to the head unit 12. Consequently, only the initiation unit 16 needs to be constructed to withstand dynamic shocks of the magnitude encountered during blasting of an adjacent blast hole/deck, whereas the head unit 12 can be constructed in a manner that does not necessarily need to withstand such dynamic shocks. Such dynamic shocks would typically result in a compressive load on a device 10 of at least 70 MPa, and commonly of the order of 100 MPa. Alternatively or additionally, the acceleration of a device 10 caused by blasting of an adjacent blast hole/deck would be at least 35,000 $m/s^2$, and commonly of the order of 50,000 $m/s^2$.

As is apparent from FIG. 1, the initiation unit 16 is significantly smaller than the head unit 12, particularly with regard to the diameters of the second and first housings 18, 14. The difference in size is in part due to the size of the components that are contained within the respective housing. One advantage of the smaller size of the second housing 18 is that the housing can more readily be constructed to withstand the dynamic shock pressures and accelerations that can be encountered during commercial blasting of rock.

In some preferred embodiments, the first housing 14 can have a diameter of approximately 20 mm to 55 mm. Further, the second housing 18 can have a diameter that is less than 10 mm.

In this particular embodiment, the first housing 14 has a first connector 24, and the first terminals 40 are provided within a recess that is surrounded by the first connector 24. Further, the second housing 18 has a second connector 26 that can be connected to the first connector 24 to mate the head and initiation units 12, 16. FIG. 1 shows the device 10 with the head and initiation units 12, 16 mated to one another; that is, with the device 10 assembled.

As will be appreciated, in this embodiment the head unit 12 is a physically separate component to the initiation unit 16; the two components (the head and initiation units 12, 16) can be mated and assembled to form the device 10. In practice, the device 10 is likely to be assembled shortly before deployment into a blast hole; for example, on the bench within the mine. This provides the device 10 with several distinct advantages including, for example, that head units 12 can be transported and stored separately to the initiation units 16. As the initiation units 16 occupy a small space, compared with the assembled device 10, the costs associated with transporting and storing a number of devices 10 is reduced. Furthermore, the head unit 12 can be subjected to full functional testing, including issuance of the initiation signal, without the risk of initiating the base charge. These tests can be performed when the head unit 12 is manufactured, whereupon faulty head units 12 can be identified and withdrawn from distribution/service.

By virtue of the relative configuration of the first and second connectors 24, 26 and the first and second terminals 40, 22, mating the first and second connectors 24, 26 connects the first and second terminals 40, 22. Thus, the processing module 36 and initiation module 20 are brought into electronic communication when the head and initiation units 12, 16 are mated and assembled.

In this particular embodiment, the initiation unit 16 relies on the head unit 12 for a source of electrical power. In other words, the initiation unit 16 does not have an independent power source within the second housing 18. Accordingly, the initiation unit 16 is inoperative until connected to an external power source, such as via connection to the head unit 12.

The head unit 12 has a third set of terminals 44 to which the battery 34 is connected. The third terminals 44 provide an open circuit between the battery 34 and the processing module 36. The initiation unit 16 has a fourth set of terminals 28 that are connected to a closing circuit 46 within the second housing 18. The third and fourth terminals 44, 28 are connectable to close the open circuit. Thus, when the third and fourth terminals 44, 28 are connected, the processing module 36 is energized by the battery 34.

In this embodiment, the closing circuit 46 is separate to the initiation module 20. Alternatively, the closing circuit can be part of the initiation module.

By virtue of the relative configuration of the first and second connectors 24, 26 and the third and fourth terminals 44, 28, mating the first and second connectors 24, 26 connects the third and fourth terminals 44, 28. Thus, when the head and initiation units 12, 16 are mated and assembled, the battery 34 is brought into electronic communication with the processing module 36. In other words, the head unit 12 is brought into an active state by assembling the head and initiation units 12, 16.

Figure 6:
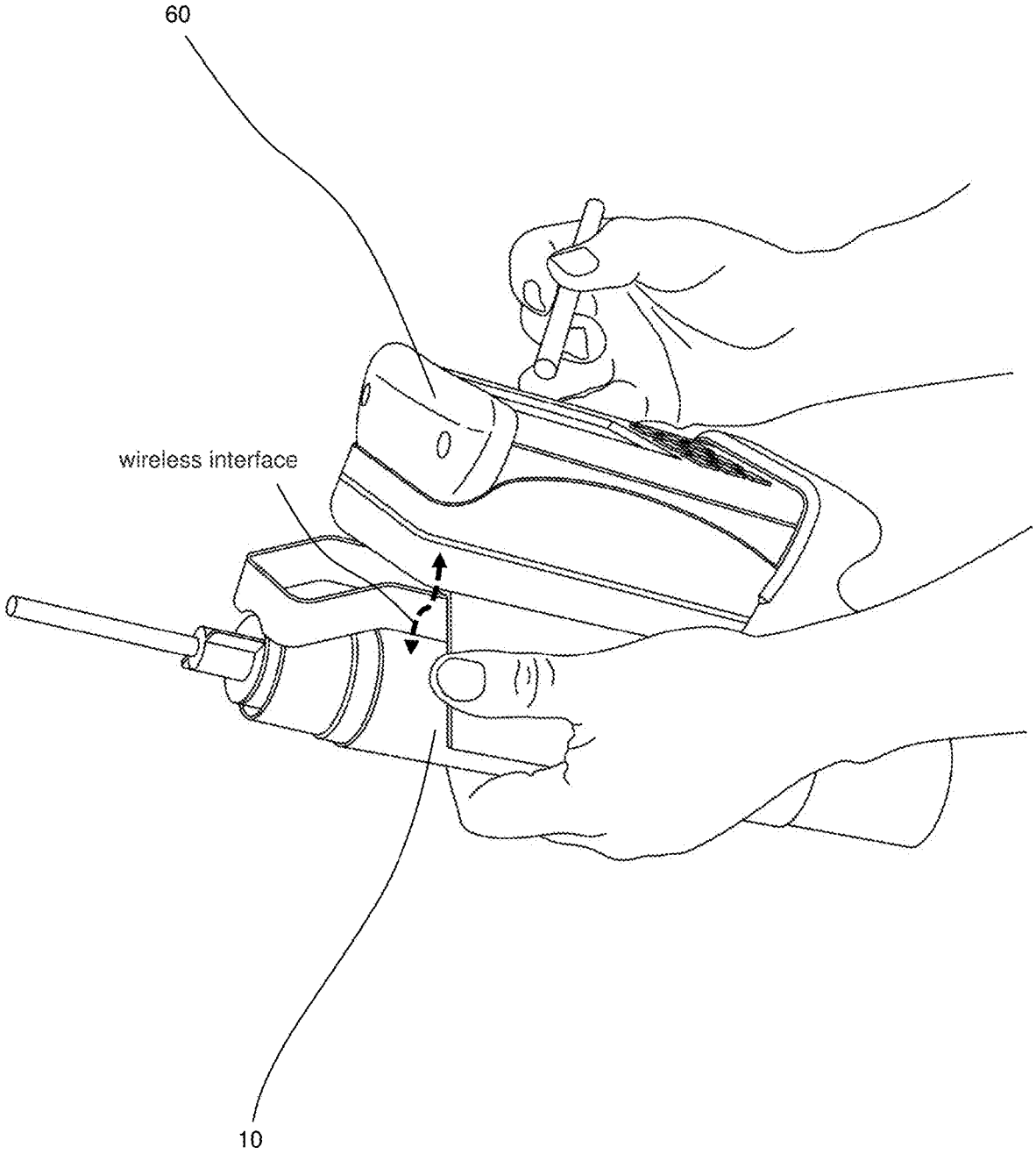
FIG. 6: is a view of a wireless initiation device according to FIG. 1, together with an encoding machine.

The processing module 36 is configured to enable programming of the head unit 12 to set various parameters of the wireless initiation device 10 that relate to a particular blast pattern. FIG. 6 shows the device 10 coupled to an encoding machine 60 (also referred to herein as an encoder), which is a handheld unit that an operator uses to program the device 10. In use, the encoding machine 60 transmits programming data to the wireless initiation device 10. Programming can include setting and/or editing a delay period for that device 10. It will be understood that a delay period is the period of time between transmission of the initiation signal and discharge of initiation energy (for example, initiation of the base charge). The processing module 36 is configured to generate a delay signal that is representative of the delay period, and transmit that delay signal to the first terminals 40. The initiation module 20 is configured to set the delay period in the electronic circuit upon receipt of a delay signal from the processing module 36. To this end, the electronic circuit can include a timing circuit.

In embodiments, the encoding machine 60 can send instructions to the processing module 36 without any acknowledgement or other return-signal from the processing module 36. In other embodiments, two-way communication can occur between the encoding machine 60 and the processing module 36.

During programming, each device 10 can be uniquely associated with a borehole, although in certain applications it may be necessary to associate up to ten devices 10 with each borehole. The encoding machine 60 can optionally send a Group Identification Device (GID) code (for example, a number, alphanumeric number, etc.) to the processing module 36 of each device 10, in addition to the delay time (for example, in milliseconds) that has been determined for the particular borehole and/or device 10 in the blast pattern. In embodiments in which two-way communication is provided, the encoding machine 60 can be configured to recover from the processing module 36 its unique (factory-programmed) identification data, and a condition report from the processing module 36.

In an alternative configuration, programming of the head unit 12, including setting/editing the delay period, occurs by transmission of wireless signals from a blasting machine that are receivable by the antenna 38. For the purposes of this specification, it is to be understood that the term "blasting machine" is to include a single unit that transmits all wireless signals for reception by wireless initiation devices 10, and also two or more independent units that each transmit various signals for reception by wireless initiation devices 10. For example, one or more units may be configured to be used in encoding/programming device(s) 10, and another unit may be configured to issue ARM and/or FIRE commands.

It will be understood that, where used in this specification, references to programming the device, head unit, and or processing module are not to be understood to by necessity include transferring operation code, software instruction set(s), or the like, to the processing module.

In some alternative embodiments, the head unit 12 may have an interface for electronic data exchange (for example, a micro-USB socket or like connector, an optical/infrared/radio wave interface, Bluetooth™, near field communication) that is connected to the processing module 36. An encoding machine 60 can be placed into communication with the head unit 12 using the interface. As will be appreciated, a wireless interface or communication protocol between the encoding machine 60 and head unit 12 has the advantage of avoiding external electrical terminals that are susceptible to corrosion in the harsh chemical environment of blasting. An optical coupling between the processing module 36 and the encoding machine 60 can be effected by a LED on the encoding machine 60, and a photocell (not shown) on the head unit 12.

When the head unit 12 receives a wireless signal that is representative of an ARM command, the processing module 36 is configured to energize part of the initiation module 20 in preparation for receipt of an initiation signal. To this end, the electronic circuit may include an energy storage device (such as a capacitor) that is chargeable by the battery 34, and is connected to a bridge wire within a fuse head. Upon discharge of the capacitor, the bridge wire blows causing the fuse head to burn, which initiates the base charge 42.

In some embodiments, the processing module 36 is configured for transmission and reception of wireless signals. In such embodiments, the head unit 12 can be interrogated by a blasting machine; for example, to determine status information regarding the device 10, to confirm the delay period set and/or programmed into the device 10, and/or to obtain individual identification data regarding the device 10, etc. In some alternative embodiments, the processing module 36 is configured only to receive wireless signals.

The first housing 14 further has a third connector that is used to mate the head unit 12 to a booster, as discussed in further detail below in connection with FIG. 8. In this particular embodiment, the first housing 14 further has a fourth connector that is used to mate the head unit 12 to a supplementary booster, as discussed in further detail below in connection with FIG. 9. Furthermore, in this embodiment, the third connector is in the form of a bayonet-type fitting that includes spring arms 30 that engage with the booster, and the fourth connector is in the form of a bayonet-type fitting that includes spring arms 32 that similarly engage with the supplementary booster. To this end, each of the spring arms 30, 32 has a retaining block that terminates at the lead end of the respective arm.

Figure 7:
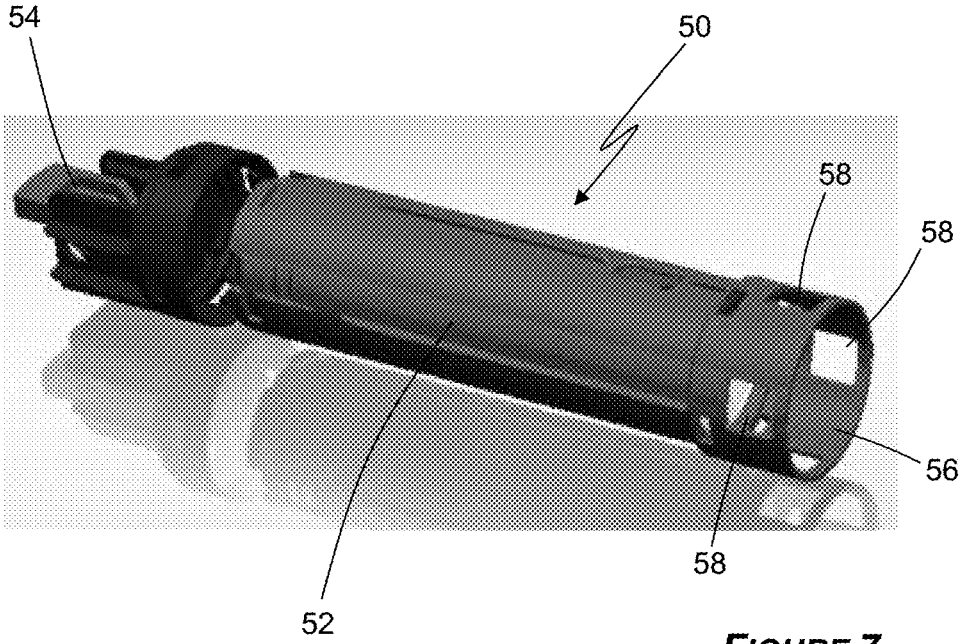
FIG. 7: is a perspective view of a booster.

FIG. 7 shows a booster 50 that includes a shell 52 that defines an internal cavity (not shown) to be charged with a confined explosive material. The booster 50 has an attachment point to which a tether can be attached for use in lowering the system into a blast hole. In the booster of FIG. 7, the attachment point is in the form of a cleat 54 that is releasably connectable to an end of the booster 50. A tether—such as a rope, cord, cable, or the like—is to be secured to the cleat 54. In one example, the tether is to pass through the cleat 54, which then restrains the tether within the cleat 54 by friction and/or a clamping force being applied to the tether.

The booster 50 has a skirt 56 that has apertures 58 that co-operate with spring arms 30, 32 of the head unit 12, as is also discussed in further detail below in connection with FIGS. 8 and 9.

Figure 8:
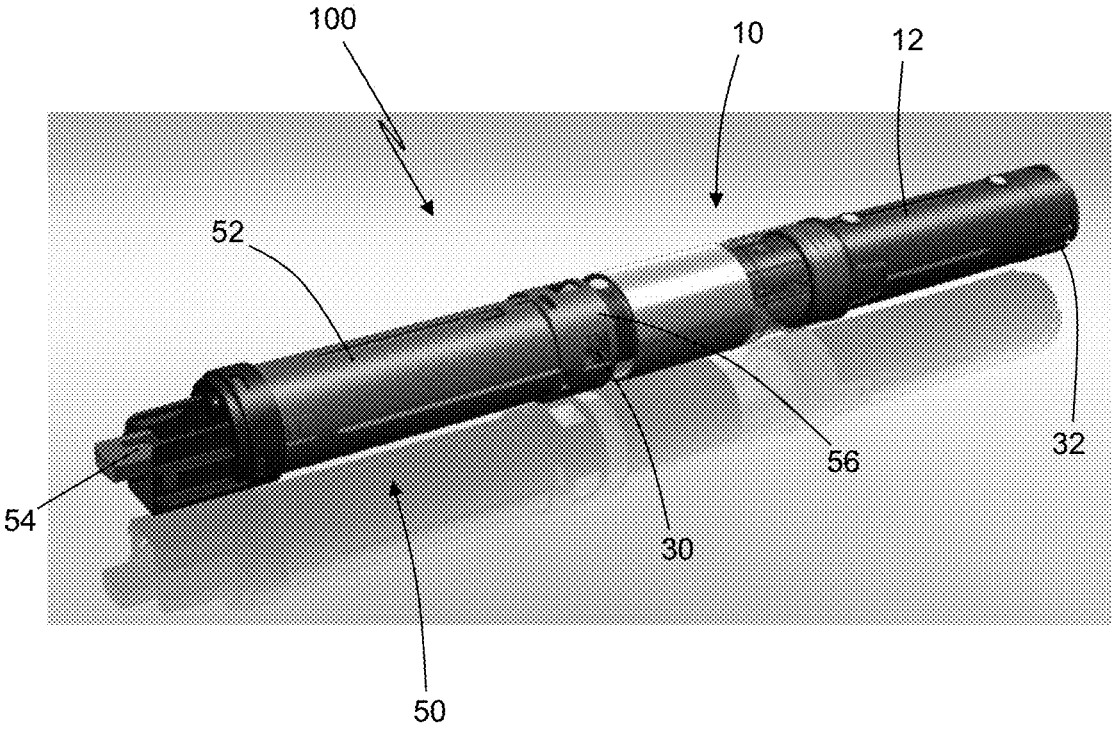
FIG. 8: is a perspective view of a primer according to a second embodiment of the present invention.

FIG. 8 shows a primer 100 according to a second embodiment. The primer 100 includes a wireless initiation device 10 as previously described in connection with FIGS. 1 to 5, and a booster 50 as previously described in connection with FIG. 7. In FIG. 8, the initiation unit is connected to the head unit 12, and then inserted into the shell 52. Accordingly, the base charge of the initiation unit is positioned within the confined explosive material within the internal cavity of the shell 52.

The skirt 56 extends over an end portion of the first housing 14. As the initiation unit 16 is inserted into the booster 50, the spring arms 30 are resiliently deflected inwards by the skirt 56. Once fully inserted, the spring arms 30 engage the skirt 56 around the apertures 58, preventing unintended disconnection of the device 10 and booster 50.

In practice, the head and initiation units 12, 16 are connected, and then the head unit 12 is programmed with various information, such as, for example the delay period. A tether is secured to the cleat 54, and the assembled wireless initiation device 10 is connected to the booster 50 to form the primer 100. The primer 100 is then ready to be lowered into a blast hole.

Figure 9:
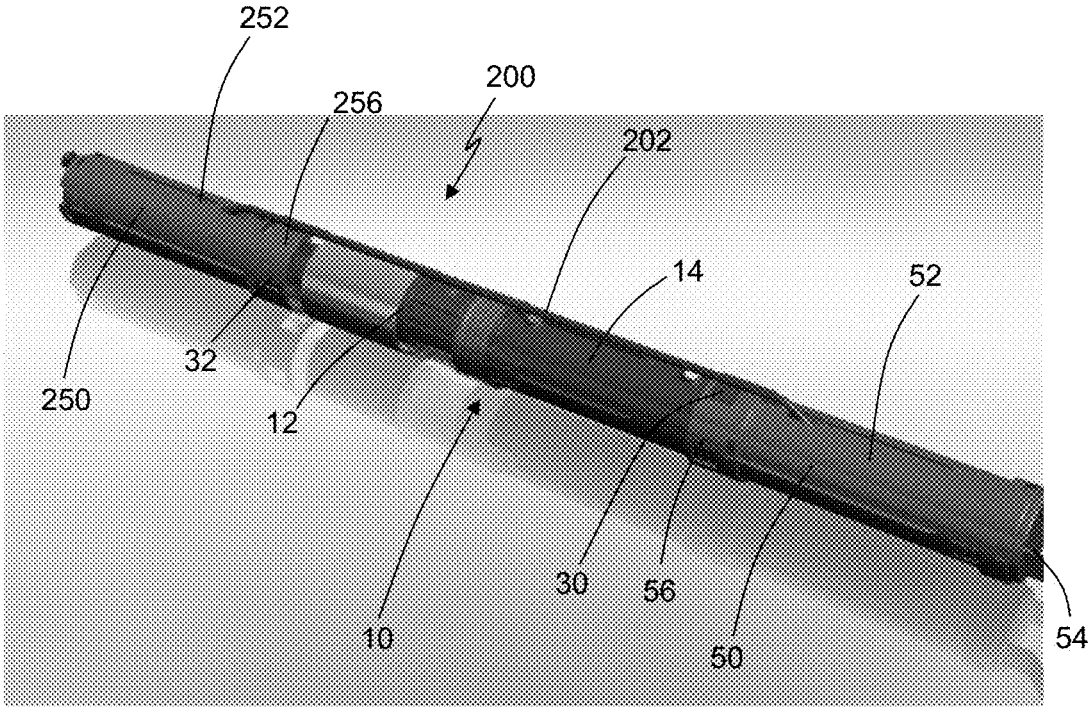
FIG. 9: is a perspective view of a primer according to a third embodiment of the present invention.

FIG. 9 shows a primer 200 according to a third embodiment. The primer 200 includes a wireless initiation device 10 as previously described in connection with FIGS. 1 to 5, and a booster 50 and supplementary booster 250 both of which are as previously described in connection with FIG. 7. Features of the supplementary booster 250 that are the same as the booster 50 have the same reference numerals with the prefix "2". In FIG. 9, the initiation unit is connected to the head unit 12, and then inserted into the shell 52 of the booster 50. Accordingly, the base charge of the initiation unit is surrounded by explosive material within the internal cavity of the shell 52.

The booster 50 and wireless initiation device 10 are connected as previously described in connection with the primer 100 of FIG. 8. Similarly, the supplementary booster 250 is connected to the spring arms 32 of the first housing 14, such that the skirt 256 extends over an opposing end portion of the first housing 14 to the booster 50. As the first housing 14 is inserted into the supplementary booster 250, the spring arms 32 are resiliently deflected inwards by the skirt 256. Once fully inserted, the spring arms 32 engage the skirt 256 around the apertures, thus preventing unintended disconnection of the device 10 and supplementary booster 250.

The primer 200 includes a detonating device to cause initiation of the supplementary booster 250. In this particular embodiment, the detonating device is a section of detonating cord 202 that extends between the internal cavities of the booster 50 and the supplementary booster 250. The primer 200 is arranged such that the booster 50 is initiated by the initiation unit 16, which initiates the detonating cord 202. The supplementary booster 250 is in turn initiated by the detonating cord 202, and thus the supplementary booster 250 acts as a slave to the booster 50.

In practice, the head and initiation units 12, 16 are connected, and the head unit 12 is programmed with various information, such as, for example the delay period. A tether is secured to the cleat 54, and the detonating cord 202 is inserted through the wall of the shell 52 of the booster 50, and then through wall of the shell 252 of the supplementary booster 250. The assembled wireless initiation device 10 is connected to the boosters 50, 250 to the form the primer 200. The primer 200 is then ready to be lowered into a blast hole.

With the arrangement of the primer 200, the supplementary booster 250 is the closest part of the primer 200 to the toe of a blast hole. Placing the supplementary booster 250 below the device 10 in the blast hole reduces the likelihood of a part of the rock around the toe of the hole remaining unbroken after the blast.

Figure 10:
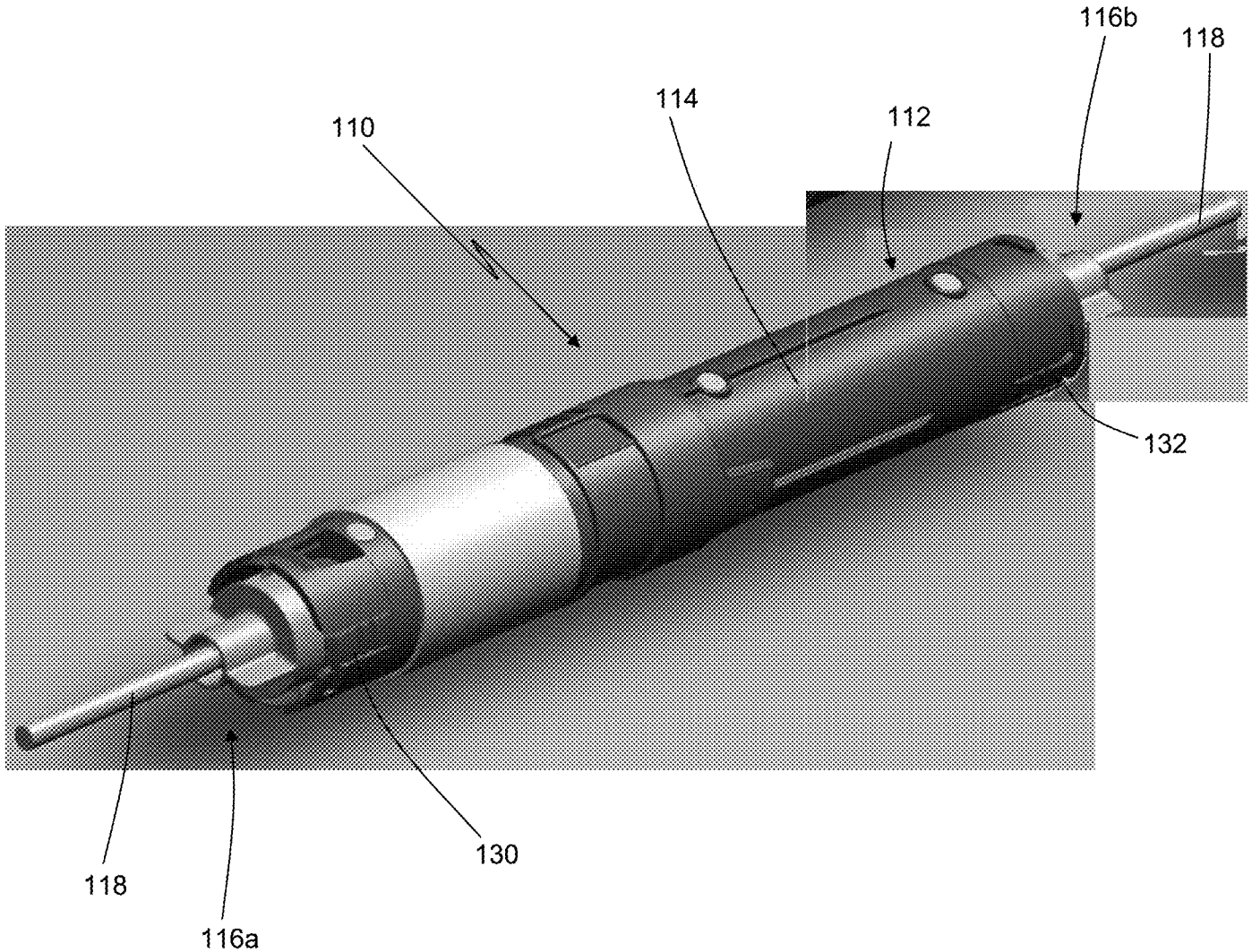
FIG. 10: is a schematic view of a wireless initiation device according to a fourth embodiment of the present invention.
Figure 11:
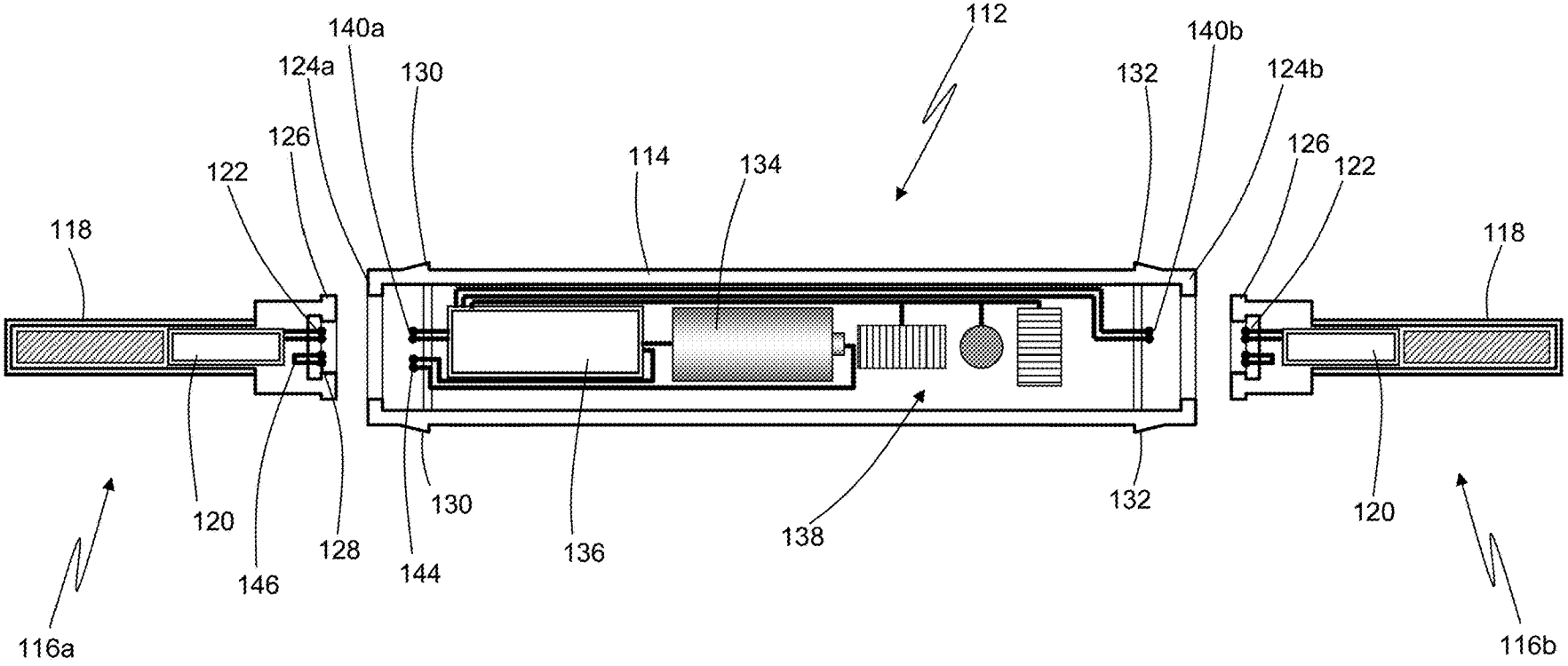
FIG. 11: is a schematic cross section view of a wireless initiation device of FIG. 10.

FIGS. 10 and 11 show a wireless initiation device 110 according to a fourth embodiment of the present invention. The wireless initiation device 110 is substantially similar to the wireless initiation device 10 of FIG. 1. The features of the device 110 that are substantially similar to those of the device 10 have the same reference numeral with the prefix "1". For example, wireless initiation device 110 includes a second housing 118, terminals 128 and 144, spring arms 130 and 132, battery 134, and closing circuit 146.

Figure 2:
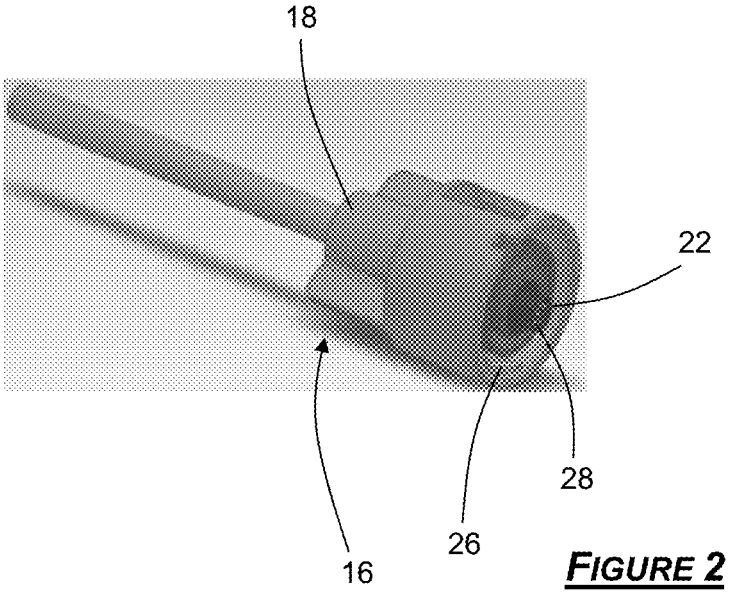
FIG. 2: is a perspective view of an initiation unit of the wireless initiation device of FIG. 1.
Figure 3:
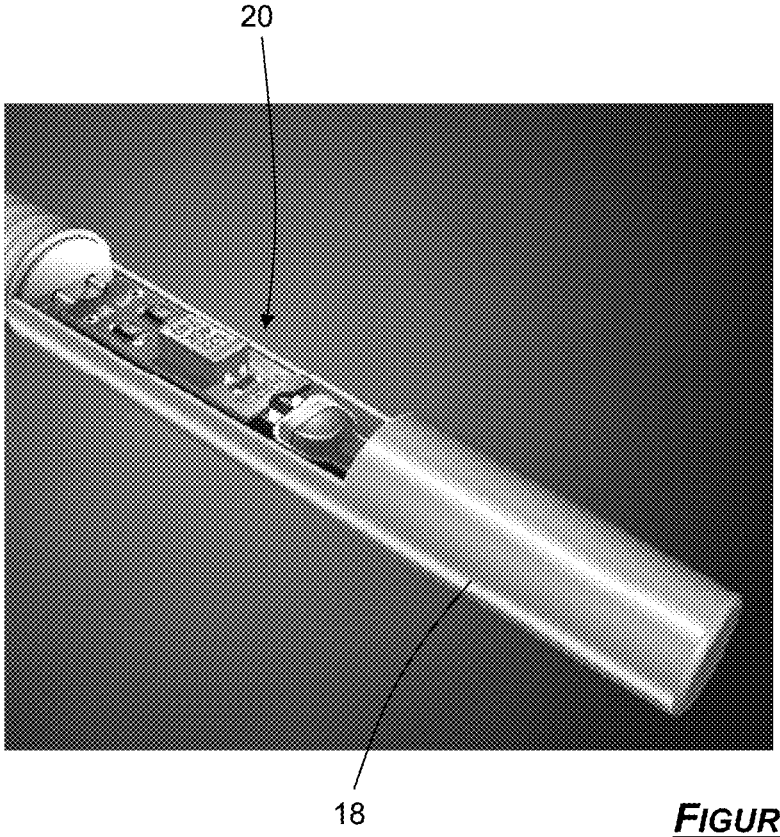
FIG. 3: is a partial cutaway view of the initiation unit of FIG. 2.
Figure 4:
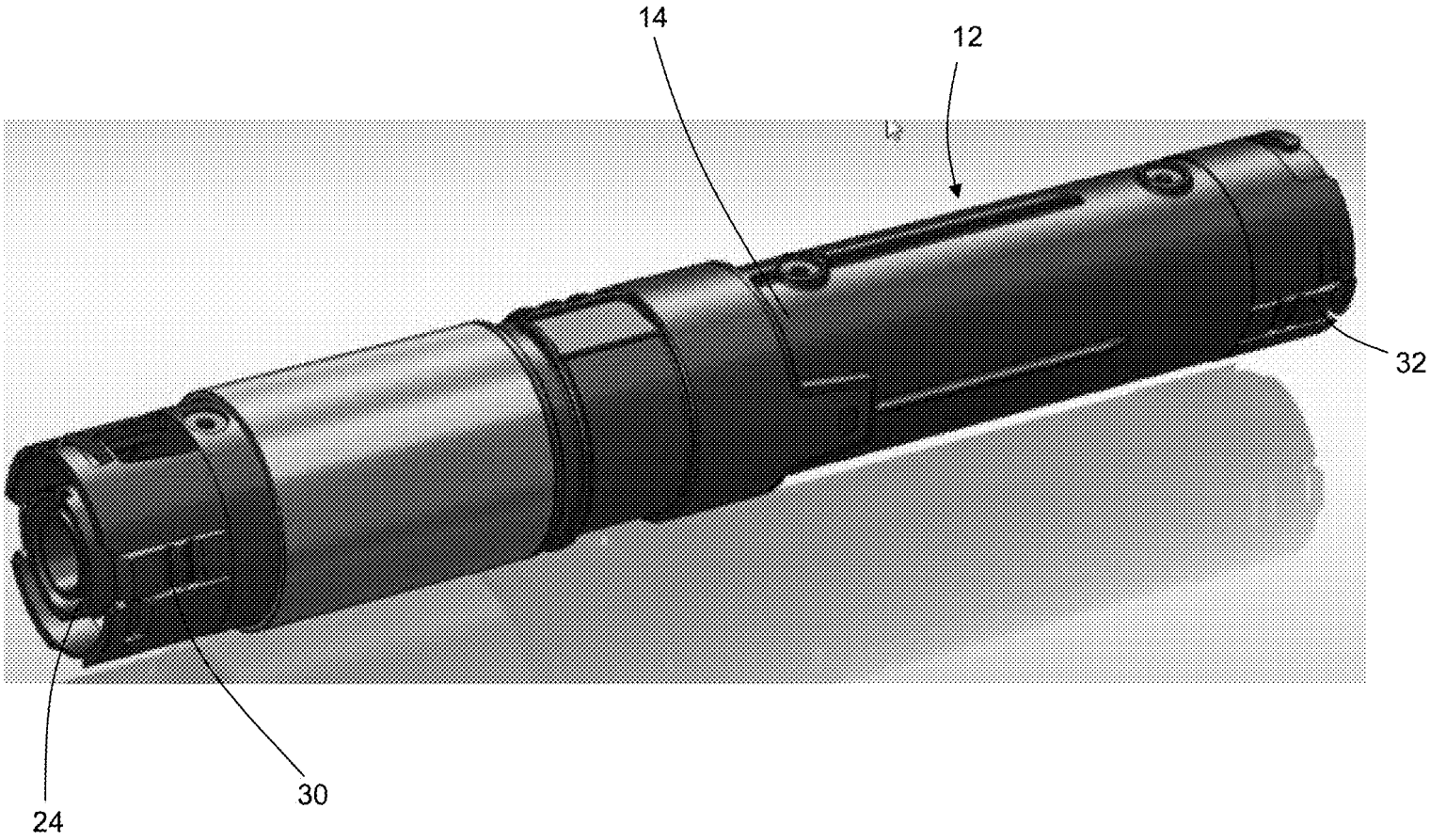
FIG. 4: is a perspective view of a head unit of the wireless initiation device of FIG. 1.
Figure 5:
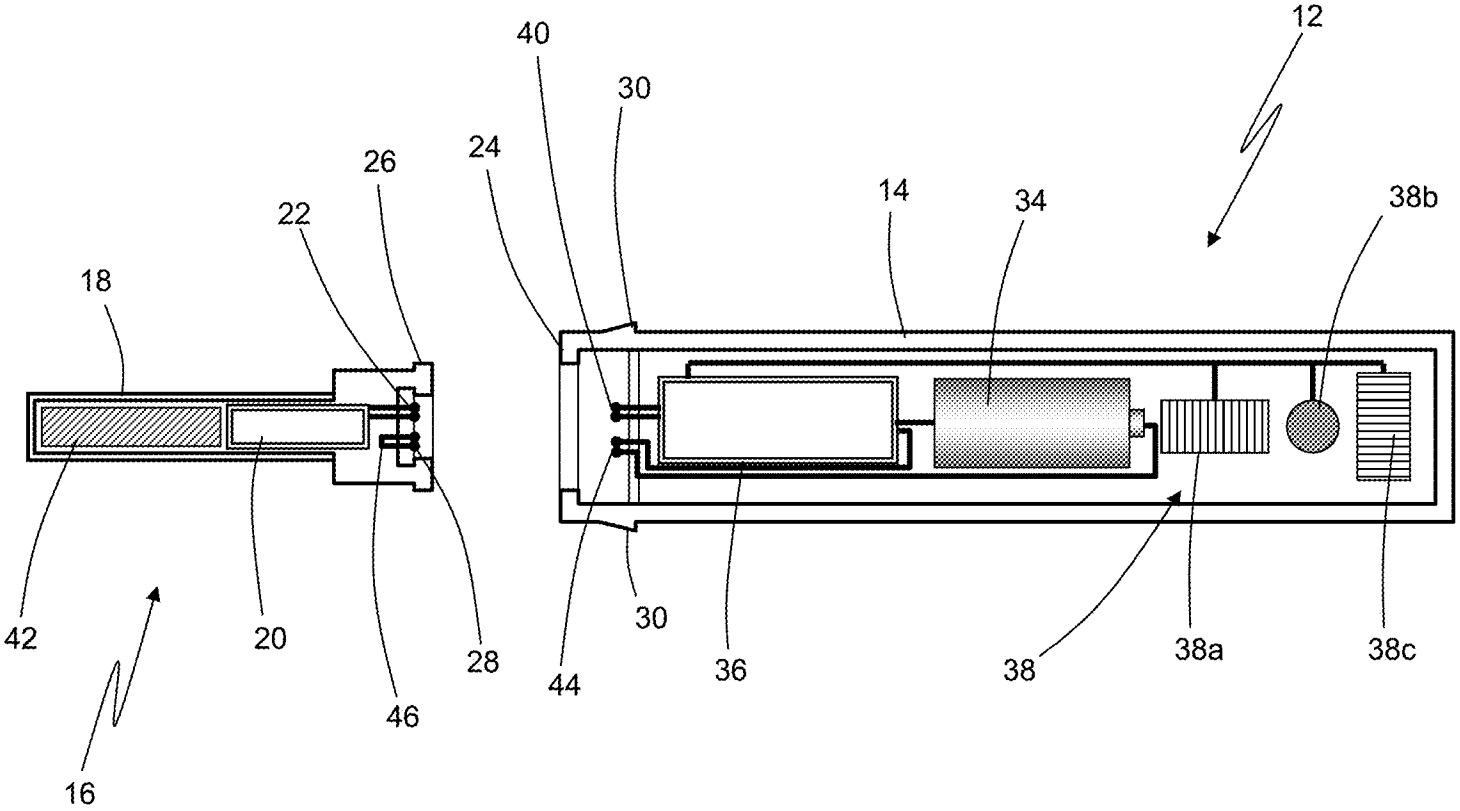
FIG. 5: is a schematic cross section view of a wireless initiation device of FIG. 1.

The device 110 has a first initiation unit 116*a*, and a second initiation unit 116*b*, that are both of the same construction and function as the initiation unit 16 shown in FIG. 2. The device 110 also has a head unit 112, that includes connectors 124*a*, 124*b* at either end of the first housing 114, and has two communications interfaces to which the processing module 136 is connected. In this embodiment, these two communications interfaces are in the form of two sets of terminals 140*a*, 140*b* to mate with the sets of terminals 122 on each of the initiation units 116*a*, 116*b*. Each of the terminals 140*a*, 140*b* is provided within a recess that is surrounded by the respective connector 124*a*, 124*b*. Thus, the two initiation units 116*a*, 116*b* can be physically connected to the head unit 112.

When initiation unit 116*a* is connected to the head unit 112, connector 124*a* is mated with the connector 126 of the first initiation unit 116*a*, terminals 140*a* are connected to the terminals 122 of the first initiation unit 116*a*. Similarly, when initiation unit 116*b* is connected to the head unit 112, connector 124*b* is mated with the connector 126 of the second initiation unit 116*b*, terminals 140*b* are connected to the terminals 122 of the second initiation unit 116*b*.

Thus, the processing module 136 is brought into electronic communication with the initiation modules 120 of both initiation units 116*a*, 116*b*, when the head and initiation units 112, 116*a*, 116*b* are mated and assembled.

When the head unit 112 is connected to both initiation units 116*a*, 116*b* and the device 110 receives, via the antenna 138, a wireless signal representing a FIRE command, the processing module 136 generates and transmits an initiation signal to both terminals 140*a*, 140*b*. The initiation signal is transferred to the initiation module 120 of both initiation units 116*a*, 116*b* via the connections between terminals 140*a*, 122, and between terminals 140*b*, 122. Upon receipt of that initiation signal the electronic circuits in the initiation modules 120 execute a sequence independently of the head unit 112 and of the other initiation unit 116. These sequences result in discharge of initiation energy from the initiation units 116*a*, 116*b*.

Figure 12:
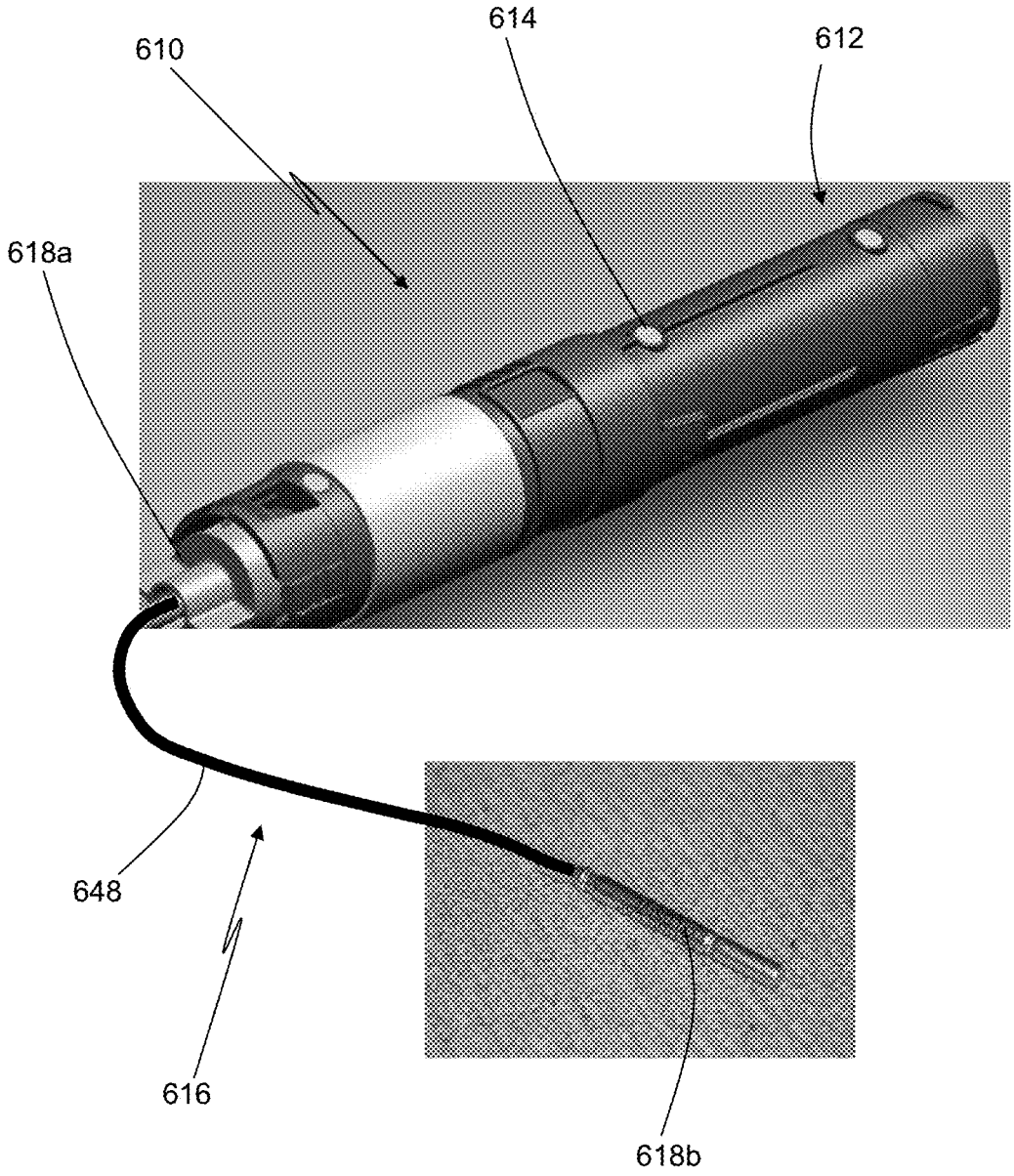
FIG. 12: is a schematic view of a wireless initiation device according to a fifth embodiment of the present invention.

FIG. 12 shows a wireless initiation device 610 according to a fifth embodiment of the present invention. The wireless initiation device 610 is substantially similar to the wireless initiation device 10 of FIG. 1. The features of the device 610 that are substantially similar to those of the device 10 have the same reference numeral with the prefix "6". For example, wireless initiation device 610 includes a first housing 614.

In the device 610, the second housing of the initiation unit 616 has a first portion 618*a* that includes the second connector (not shown), and a second portion 618*b* in which a base charge (not shown) is disposed. The initiation unit 616 further has an electrically conductive lead 648 that extends between the first and second portions 618*a*, 618*b* of the initiation unit housing. In this way, the base charge is spaced from the head unit 612 when the device 610 is assembled.

As will be appreciated, the initiation module can be disposed in the first portion 618*a* of the housing, in which case the lead 648 connects the initiation module to the base charge. Alternatively, the initiation module can be disposed in the second portion 618*b* of the housing, in which case the lead 648 connects the second set of terminals to the initiation module.

As will be appreciated, in use of the device 610, the second portion 618*b* of the housing is to be embedded within a booster. However, as distinct to other embodiments, the booster is not directly connected to the head unit 612.

Figure 13:
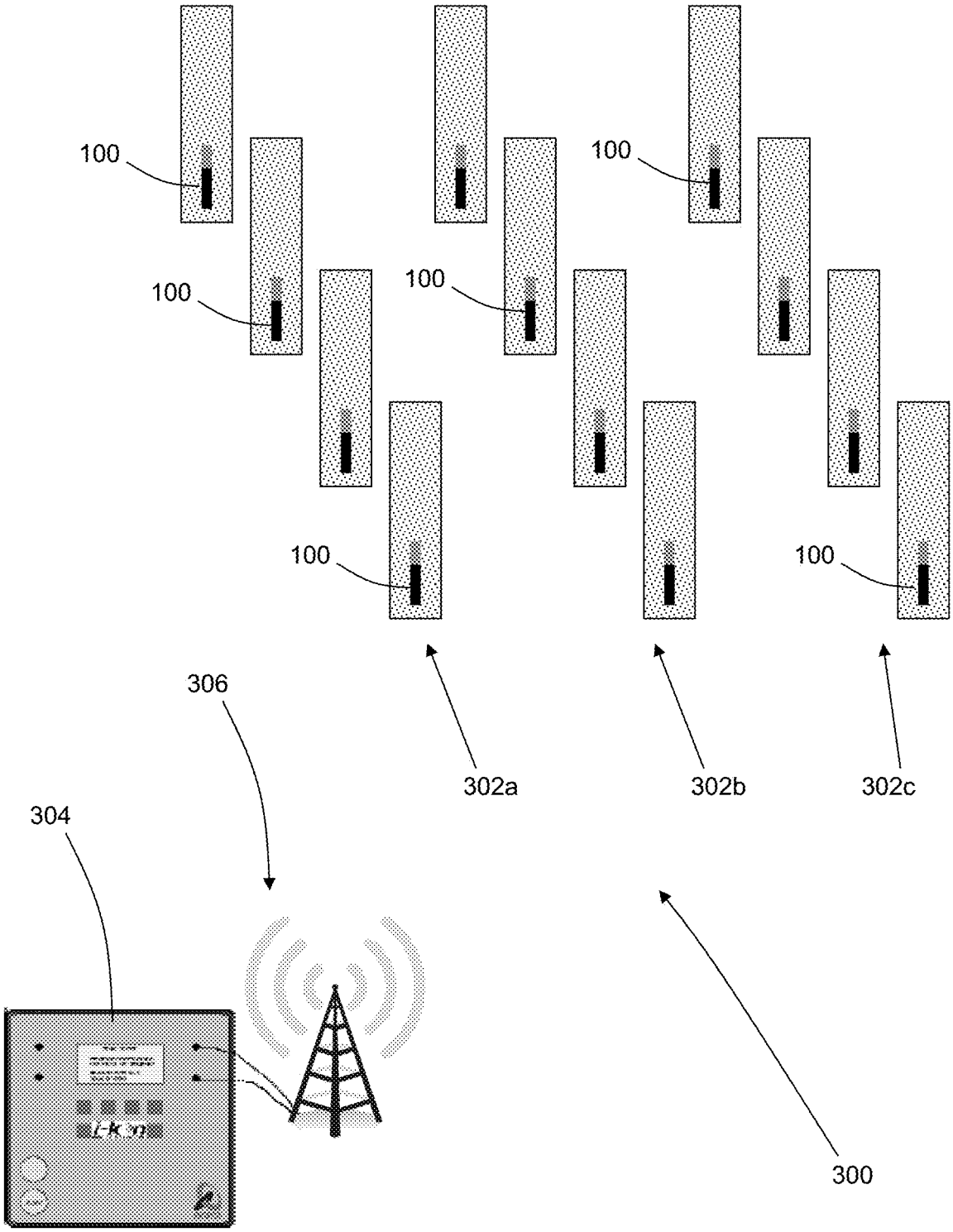
FIG. 13: is a schematic view of an initiation system according to a sixth embodiment of the present invention.

FIG. 13 shows an initiation system 300 for initiating explosive charges in an array of blast holes. The array is arranged into three sets 302*a*, 302*b*, 302*c* of blast holes, with each set containing four individual blast holes. By way of example only, the blast pattern can be constructed such that the blast holes in each set 302*a*, 302*b*, 302*c* are to be blasted simultaneously, and the sets are to be blasted sequentially.

It will be understood that, in this context, a "simultaneous blast" of two or more holes can have short delays (of the order of milliseconds) between the individual blasts. Similarly, a "sequential blast" of two or more holes can have blasts separated temporally by at least one second, and even hours, days or months, depending upon the blast operation.

The system 300 includes a primer 100 located near the toe of each blast hole. Each primer 100 is in accordance with the embodiment of FIG. 8. A bulk explosive and stemming material are loaded into the blast hole, as per standard practice. The system 300 further includes a blasting machine 304 that is configured to transmit wireless signals for reception by the devices of the primers 100. In particular, the blasting machine 304 is configured to transmit a wireless signal representative of a FIRE command. Following receipt the signal representative of the FIRE command, the electronic circuit of each device executes a sequence independently of the head unit of that device and the blasting machine. The sequence results in initiation of the base charge of that device.

When the head unit of each primer 100 receives a wireless signal that is representative of an ARM command, the initiation module is energized in preparation for receipt of an initiation signal. Energizing the initiation module may involve increasing the voltage stored in the initiation module from a "safe" voltage, where initiation energy is insufficient to initiate the attached base charge, to a "firing" voltage capable of initiating the base charge.

In this example, the wireless signal representing the FIRE command is received effectively simultaneously by all the primers 100. All the head units of the primers 100 generate and transmit an initiation signal to the respective initiation module. Accordingly, all initiation units commence their respective sequence that results in initiation of the base charge of that device.

By way of example, the primers 100 of set 302*a* are programmed to initiate their boosters immediately upon receipt of the FIRE command; that is, the delay period of the initiation units is zero. The primers 100 of set 302*b* are programmed to initiate their boosters 10 milliseconds after receipt of the FIRE command; that is, the delay period of the initiation units is 10 milliseconds. Finally, the primers 100 of set 302*c* are programmed to initiate their boosters 20 milliseconds after receipt of the FIRE command;

that is, the delay period of the initiation units is 20 milliseconds.

In this example, the wireless initiation devices in sets 302*b* are subjected to dynamic shocks and accelerations created by detonation of the bulk explosives in the set 302*a*. Similarly, the wireless initiation devices in set 302*c* are subjected to dynamic shocks and accelerations created by detonation of the bulk explosives in the sets 302*a* and 302*b*.

The system includes a transmitter 306 to which the blasting machine 304 is connected. In FIG. 13, the transmitter 306 is shown schematically. In one form, the transmitter 306 can include a signal generator able to send an oscillating current into a low resistance transmitting antenna that has one or more conductive coils capable of carrying a large oscillating electrical current. The required range and power of the transmitter 306 can depend upon factors that include: the size of the blast; the sensitivity of the processing modules 36 and antennae 38; and ambient magnetic noise in the blast environment. The strength of the magnetic field generated can depend, for example, on the diameter and number of turns of the coils, the current flowing through them, etc. The number of turns in a transmitting antenna can be small and may be, for example, one. The current may be, for example, tens to hundreds of Amperes, and the coil diameter may be, for example, tens to hundreds of meters. Alternatively, relatively smaller antennae may also be used that comprise one or more separate coils supplied from the same current source. In some embodiments, the fields of the individual coils can be additive, but each coil can be small enough to be portable. The frequency of the oscillating current and therefore of the oscillating magnetic field is preferably in the range 20 to 2500 Hz.

Reference is made to International Publication No. WO 2007/124538, which includes disclosure of methods of communicating between components in a blasting system that includes transmission of wireless signals through rock. The signal may be digitally coded using, for example FSK, AM, FM or other means. The transmitter 306 can be powered by, for example, batteries or mains. Lead acid batteries can be used as a portable power source for their ability to provide large currents for relatively short periods.

In FIG. 13, the blasting machine 304 is illustrated as a single device. However, the blasting machine may be two or more independent units that operate either, separately or in co-ordination, to collectively perform the function of the blasting machine 304, as previously discussed.

Figure 14:
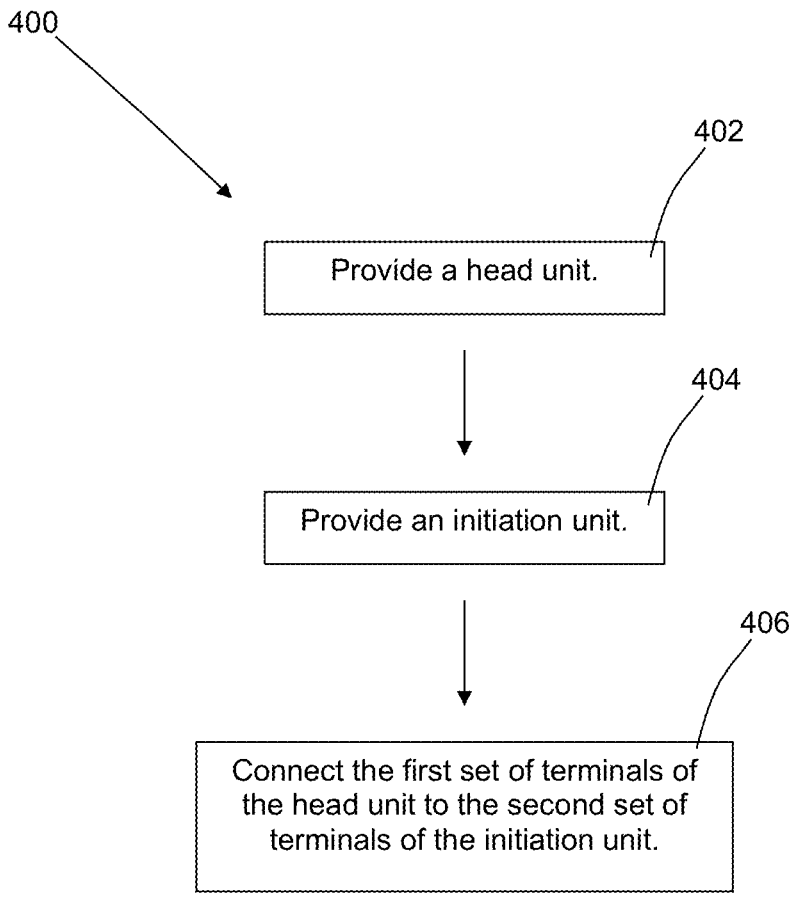
FIG. 14: is a simplified flow chart showing a method of assembling a wireless initiation device according to a seventh embodiment of the present invention.

FIG. 14 is a simplified flow chart showing a method 400 of assembling a wireless initiation device. The method 400 includes the following steps:

a) Provide a head unit (step 402). The head unit can be as per the embodiment described in connection with FIGS. 1 to 5.

b) Provide an initiation unit (step 404). The initiation unit can be as per the embodiment described in connection with FIGS. 1 to 5.

c) Connect a first set of terminals of the head unit to a second set of terminals of the initiation unit (step 406).

Accordingly, the head unit has a housing within which is disposed a power source, at least part of an antenna, and a processing module for processing wireless signals that are receivable by the antenna, the wireless signals including a wireless signal representative of a FIRE command. The processing module is connected to the first set of terminals, and the processing module is configured to generate and transmit an initiation signal to the terminals upon receipt of that wireless signal.

Further, the initiation unit has a housing within which is disposed an initiation module that is configured to discharge initiation energy sufficient to initiate an explosive charge associated with the initiation unit. The second set of terminals is connected to the initiation module. When the second set of terminals is connected to the first set of terminals, the initiation module can receive electronic communication from the head unit. As previously described, the initiation module is configured to execute a sequence independently of the head unit upon receipt of an initiation signal from the head unit. This sequence results in discharge of initiation energy from the initiation unit.

In some embodiments, an explosive charge associated with the initiation unit may be external to the initiation unit. In such cases, the housing of the initiation unit can be made less durable than the explosive device.

When the head unit receives a FIRE command, the processing module generates and transmits an initiation signal to the initiation module, such that the initiation unit then executes the sequence independently of the head unit.

Figure 15:
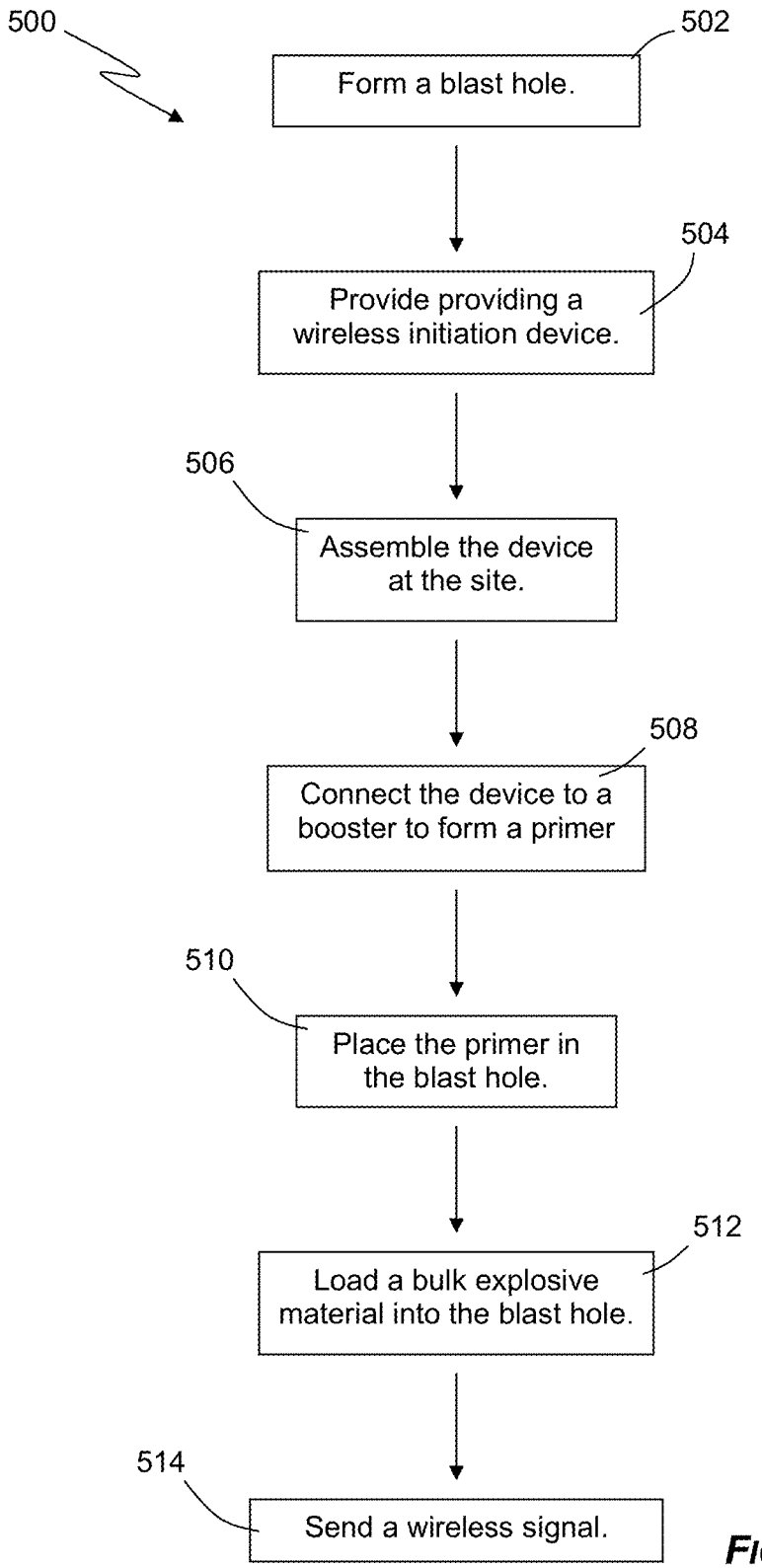
FIG. 15: is a simplified flow chart showing a method of blasting rock at a site according to an eighth embodiment of the present invention.

FIG. 15 is a simplified flow chart showing a method 500 of blasting rock at a site. The method 500 involves the steps of:

a) Form a blast hole in the rock (step 502).

b) Provide a wireless initiation device (step 504).

c) Assemble the device at the site, which includes mating the first and second connectors to connect the first housing to the second housing (step 506).

d) Connect the device to a booster that includes a confined explosive material that is initiated by the initiating energy discharged from the initiation unit to form a primer (step 508).

e) Place the primer in the blast hole (step 510).

f) Load a bulk explosive material into the blast hole (step 512).

g) Send a wireless signal representative of a FIRE command from a blasting machine (step 514).

The wireless initiation device provided in step (b) 504 may be as previously described, for example as per the embodiment of FIGS. 1 to 5. Similarly, the booster of step (d) 508 may be as per the example described in connection with FIG. 7.

Prior to step (g) 514 above, the method may also involve sending a wireless signal that is representative of an ARM command from the blasting machine. Upon receipt of the wireless signal representative of an ARM command, the processing module energizes the initiation module in preparation for receipt of an initiation signal. As previously described, energizing the initiation module may involve increasing the voltage stored in the initiation module from a "safe" voltage, where initiation energy is insufficient to initiate the attached base charge, to a "firing" voltage capable of initiating the base charge.

Upon receipt of the wireless signal representative of the FIRE command via the antenna, the processing module generates an initiation signal and transmits that signal to the initiation module. Furthermore, upon receipt of the initiation signal the initiation module executes a sequence that results in discharge of initiation energy from the initiation unit to initiate the confined explosive material. The initiation of the confined explosive material causes initiation of the bulk explosive material.

As the initiation unit is only connected to the power supply and/or the processing module in step (c) 506 above, the initiation module is unable to discharge initiation energy until step (c) 506.

Step (e) 510 can involve attaching a tether to the attachment point of the booster.

As will be appreciated, certain steps of the method 500 do not need to be conducted in the order described or illustrated in FIG. 14.

The method 500 can include an additional step of programming the device. This additional step can occur at any time prior to Step (g) 514. Further, programming the device may be effected using an encoding machine, as previously described. There is an additional safety benefit in executing the additional step of programming the device prior to Step (e) 510.

Assembling the device at the site has the advantage that the device is only brought into a condition that is potentially active near the position in which it is to be placed/deployed. To this end, the device can be assembled at any convenient location, for example, adjacent the blast hole, on a bench near which the blast hole is formed within the site, within an underground tunnel at the site, or at the collar of the blast hole.

A ninth embodiment of the present invention provides a method of transporting a wireless initiation device to a mine site. The wireless initiation device provided in step (b) 504 may be as previously described, for example as per the embodiment of FIGS. 1 to 5. The method of this embodiment involves transporting the device such that the initiation unit is spatially separated from the power source during transport.

Thus, the initiation unit can be transported in a first transport facility, and the head unit—with the components disposed in that housing—can be transported in a second transport facility. The first transport facility can be selected to meet the safety requirements needed for transport of the initiation unit, particularly with regard to the form and function of the initiation module. The second transport facility can be selected to meet a lower safety requirement due to the function of the components of the power source.

In the example of the device of FIGS. 1 to 5, the initiation unit 16, which includes a base charge 42 that detonates to discharge initiation energy, can be stored with other devices that are capable of discharging initiation energy, such as, for example, other initiation units 16, in a first transport facility that is suitable for carrying hazardous goods. The head unit 12 and power source can be stored with other non-hazardous devices, such as, for example, other head units 12, in a second transport facility that is suitable for carrying non-hazardous goods. The capacity required to transport multiple initiation units 16 is significantly smaller than that required to transport multiple assembled devices 10, which reduces transport costs.

In one example, the first transport facility can be a physically separate space to the second transport facility. Both transport facilities can be transported by common freight vehicles to the mine site. Alternatively or additionally, the initiation unit can be transported in a first shipment to the mine site, and the power source can be transported in a second shipment to the mine site. In embodiments in which the power source is disposed within the head unit (or at least the first housing), the power source can be transported with the head unit (or the first housing).

The embodiments described with reference to the drawings are non-limiting examples only. Modifications and variations may be made without departing from the spirit and scope of the invention.

For example, one alternative embodiment of a wireless initiation device has a power source, a processing module for processing wireless signals received by an antenna, an initiation module that is configured to discharge initiation energy sufficient to initiate an explosive charge associated with the device.

The wireless signals include a wireless signal that is representative of a FIRE command. Additionally, the wireless signals can include one or more signals that are known in the field of blasting, for example ARM, SLEEP, WAKE, and the like.

In some embodiments, the wireless initiation device may require receipt of a pre-determined number of wireless signals that are each representative of a single command, in order to process and act on that command. Additionally, the pre-determined number of wireless signals may need to be received within a pre-determined time window, and/or with a maximum time interval between two consecutive wireless signals. In some instances, there may be benefit in configuring the wireless initiation device to require that at least some of the pre-determined number of wireless signals be non-identical. In one example, an embodiment of a wireless initiation device may require receipt of five non-identical wireless signals, with consecutive wireless signals separated being separated by intervals of no more than 30 seconds and each of the five signals being representative of a FIRE command, in order to act on that command, and initiate a sequence that results in discharge of initiation energy.

The processing module is configured to generate an initiation signal upon receipt of the FIRE command. The initiation module is either connected to, or connectable with, the processing module. When the processing and initiation modules are connected the initiation module can receive an initiation signal from the processing module. Further, the initiation module is configured to execute a sequence independently of the processing module and power source upon receipt of the initiation signal, and the sequence results in discharge of initiation energy from the initiation module.

It will be understood that in some embodiments, the initiation module and processing module can be configured such that signals, such as the initiation signal, are communicated via communication interfaces that do not employ a physical interconnection. One example of such communication interfaces are short-distance wireless communication, such as electromagnetic induction between two loop antennae via which the two modules exchange information. The range of such wireless communication may be up to 10 centimetres. Accordingly, it will be understood that the expressions "connected to", "connectable with" and the like, where used in this specification, are to include wireless connections that enable the exchange of electronic information.

Embodiments with first and second communication interfaces that do not employ a physical interconnection may enable reliable electronic communication between the processing and initiation modules, even when the wireless initiation device is deployed in adverse environments (such as in moist environments at high hydrostatic pressures). The reliability of such communication interfaces may have benefits that include reducing errors that may cause a misfire, premature or unintentional detonation. In addition, shorting of a physical terminal connection due to moisture ingress, or misalignment due to improper connection of housing pieces may be minimized, or even prevented. In such embodiments, even if a housing was abraded, cracked or otherwise provided some accidental exposure of the interior of the housing during transport or deployment of the wireless initiation device, integrity of the communication could be maintained due to protected wireless terminals.

In this alternative embodiment, if the processing module is damaged by a dynamic shock created by a blast in an adjacent blast hole/deck after the initiation signal has been received by the initiation module, the initiation module will continue to execute the sequence and discharge initiation energy.

In one example, there is an uninterruptible electrical connection between the processing and initiation modules. In an alternative, a switch is provided to selectively connect and interrupt an electrical connection between the processing and initiation modules.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps

The invention claimed is:

1. A wireless initiation device, including:

a housing, a processor disposed within the housing and configured to process wireless electromagnetic communications signals including a wireless electromagnetic communications signal representative of a FIRE command, the processor configured to generate an initiation signal upon receipt of the FIRE command; and a circuit configured to discharge initiation energy sufficient to initiate an explosive charge associated with the wireless initiation device, the circuit configured to be communicatively coupled to the processor such that the circuit can receive the initiation signal from the processor that results in the discharge of the initiation energy, wherein the processor is configured for wireless electronic data exchange with an encoder configured to transmit programming data wirelessly to the wireless initiation device, wherein the programming data include a delay period for the wireless initiation device, and/or wherein programming of a delay period occurs by transmission of one or more wireless electromagnetic communications signals that are receivable by an antenna disposed within the housing, and wherein the delay period has been determined for the particular wireless initiation device in a blast pattern.

2. The wireless initiation device of claim 1, wherein the wireless electronic data exchange with the encoder includes near field communication, and/or wherein the encoder sends a Group Identification Device (GID) code to the processor of the wireless initiation device.

3. A wireless initiation device, including:

a housing, a processor disposed within the housing and configured to process wireless electromagnetic communications signals including a wireless electromagnetic communications signal representative of a FIRE command, the processor configured to generate an initiation signal upon receipt of the FIRE command; and a circuit configured to discharge initiation energy sufficient to initiate an explosive charge associated with the wireless initiation device, the circuit configured to be communicatively coupled to the processor such that the circuit can receive the initiation signal from the processor that results in the discharge of the initiation energy, wherein the processor is configured for wireless electronic data exchange with an encoder configured to transmit programming data, including parameters that relate to a blast pattern, wirelessly to the wireless initiation device.

4. The wireless initiation device of claim 1, wherein the encoder is a handheld unit.

5. The wireless initiation device of claim 1, wherein the processor is configured for one-way communication with the encoder.

6. The wireless initiation device of claim 1, wherein the processor is configured for two-way communication with the encoder, and the encoder is configured to recover from the processor one or more of:

a unique (factory-programmed) identification data of the wireless initiation device;

a condition report of the wireless initiation device; and the delay period set and/or programmed into the wireless initiation device.

7. The wireless initiation device of claim 1, further comprising the antenna, the antenna being a tri-axial coil antenna that has three coils mounted orthogonally with respect to each other coupled to the processor.

8. The wireless initiation device of claim 1, wherein the wireless electromagnetic communications signals include at least one frequency in the range 20 to 2500 Hz, and/or wherein the wireless electromagnetic communications signals are transmitted through rock.

9. The wireless initiation device of claim 1, further comprising a switch configured to interrupt a flow of current between a power source and the processor, wherein the switch is normally open.

10. The wireless initiation device of claim 1, wherein the wireless electromagnetic communications signals include a wireless electromagnetic communications signal representative of an ARM command, and the processor is configured to generate and transmit an energization signal upon receipt of the ARM command to energize part of the circuit in preparation for discharge of the initiation energy upon receipt of the initiation signal.

11. The wireless initiation device of claim 1, including a base charge that discharges the initiation energy by detonation, the base charge being connected to the circuit by an electrically conductive lead, and wherein the circuit is configured to cause the detonation of the base charge.

12. The wireless initiation device of claim 1, wherein the housing is a first housing, the wireless initiation device further comprising:

a second housing; and a base charge disposed within the second housing.

13. The wireless initiation device of claim 1, wherein the circuit is configured to execute a sequence configured to cause the discharge of the initiation energy.

14. A primer including:

the wireless initiation device of claim 1; and a booster that includes a confined explosive material that is initiated by the initiating energy discharged from the circuit.

15. An initiation system for initiating bulk explosive charges in a plurality of blast holes, wherein the encoder is an encoding transmitter, the system including:

a plurality of wireless initiation devices of claim 1;

a blasting transmitter that is configured to transmit the wireless electromagnetic communications signals for reception by the wireless initiation devices; and the encoder, the encoder configured to program each wireless initiation device from the plurality of wireless initiation devices, when the encoder is communicatively coupled with that wireless initiation device.

16. The initiation system of claim 15, wherein the blasting transmitter includes a signal generator configured to send an oscillating current into a low resistance transmitting antenna that has one or more conductive coils capable of carrying a large oscillating electrical current.

17. A method for blasting, comprising:

wirelessly coupling a wireless initiation device to an encoding machine;

programming the wireless initiation device by transmitting programming data by wireless electronic data exchange from the encoding machine;

receiving wireless electromagnetic communications signals at the wireless initiation device in a borehole, the wireless electromagnetic communications signals including a wireless electromagnetic communications signal representative of a FIRE command from a blasting machine;

generating an initiation signal upon receipt of the FIRE command; and responsive to the initiation signal, discharging initiation energy sufficient to initiate an explosive charge associated with the wireless initiation device.

18. A wireless initiation device, including:

a housing, a processor disposed within the housing and configured to process wireless electromagnetic communications signals including a wireless electromagnetic communications signal representative of a FIRE command, the processor configured to generate an initiation signal upon receipt of the FIRE command; and a circuit configured to discharge initiation energy sufficient to initiate an explosive charge associated with the wireless initiation device, the circuit configured to be communicatively coupled to the processor such that the circuit can receive the initiation signal from the processor that results in the discharge of the initiation energy, wherein the processor is configured for wireless electronic data exchange with an encoder configured to transmit programming data wirelessly to the wireless initiation device, and wherein the wireless initiation device includes a base charge that discharges the initiation energy by detonation, the base charge being connected to the circuit by an electrically conductive lead, and wherein the circuit is configured to cause the detonation of the base charge.

19. A wireless initiation device, including:

a first housing;

an antenna disposed within the first housing;

a processor disposed within the first housing and configured for wireless electronic data exchange of programming data with an encoder via an antenna, including a wireless electromagnetic communications signal representative of a FIRE command, the processor configured to generate an initiation signal upon receipt of the FIRE command;

a second housing;

a base charge disposed within the second housing; and a circuit disposed within the second housing and configured to discharge initiation energy sufficient to initiate the base charge, the circuit configured to be communicatively coupled to the processor such that the circuit can receive the initiation signal from the processor that results in the discharge of the initiation energy.

20. A primer including:

a wireless initiation device, including:

a housing, a processor disposed within the housing and configured to process wireless electromagnetic communications signals including a wireless electromagnetic communications signal representative of a FIRE command, the processor configured to generate an initiation signal upon receipt of the FIRE command, and a circuit configured to discharge initiation energy sufficient to initiate an explosive charge associated with the wireless initiation device, the circuit configured to be communicatively coupled to the processor such that the circuit can receive the initiation signal from the processor that results in the discharge of the initiation energy, wherein the processor is configured for wireless electronic data exchange with an encoder configured to transmit programming data wirelessly to the wireless initiation device; and a booster that includes a confined explosive material that is initiated by the initiating energy discharged from the circuit.

21. An initiation system for initiating bulk explosive charges in a plurality of blast holes, the system including:

a plurality of wireless initiation devices, each wireless initiation device including:

a housing, a processor disposed within the housing and configured to process wireless electromagnetic communications signals including a wireless electromagnetic communications signal representative of a FIRE command, the processor configured to generate an initiation signal upon receipt of the FIRE command, and a circuit configured to discharge initiation energy sufficient to initiate an explosive charge associated with the wireless initiation device, the circuit configured to be communicatively coupled to the processor such that the circuit can receive the initiation signal from the processor that results in the discharge of the initiation energy, wherein the processor is configured for wireless electronic data exchange with an encoder configured to transmit programming data wirelessly to the wireless initiation device, wherein the encoder is an encoding transmitter; and a blasting transmitter that is configured to transmit the wireless electromagnetic communications signals for reception by the wireless initiation devices; and the encoder, the encoder configured to program each wireless initiation device from the plurality of wireless initiation devices when the encoder is communicatively coupled with that wireless initiation device.

* * * * *